US006060206A

United States Patent [19]

Hanaki et al.

[11] Patent Number: 6,060,206

[45] Date of Patent: May 9, 2000

[54] PHOTO- AND HEAT-SENSITIVE RECORDING MATERIAL AND COLORANT PRODUCED FROM THE MATERIAL

[75] Inventors: Koichi Hanaki, Kanagawa; Yasuhiro Mitamura, Shizuoka-ken; Atsuhiro Ohkawa, Kanagawa, all of Japan

[73] Assignee: Fuji Photo Film Co., Ltd., Kanagawa, Japan

[21] Appl. No.: 09/164,588

[22] Filed: Oct. 1, 1998

[30] Foreign Application Priority Data

Oct. 1, 1997 [JP] Japan ..... 9-268662

[51] Int. Cl.[7] ..... B03C 1/58

[52] U.S. Cl. ..... 430/138; 430/179; 430/183; 430/185; 430/186; 430/182

[58] Field of Search ..... 430/182, 179, 430/138, 189, 185, 186

[56] References Cited

U.S. PATENT DOCUMENTS

| | | | |
|---|---|---|---|
| 2,548,845 | 4/1951 | Neumann et al. | 430/182 |
| 3,632,344 | 1/1972 | Moraw et al. | 430/179 |
| 3,899,335 | 8/1975 | Przezdziecki | 430/151 |
| 3,910,794 | 10/1975 | Buisine et al. | 430/182 |
| 4,957,847 | 9/1990 | Adam et al. | 430/170 |
| 5,407,777 | 4/1995 | Shimada et al. | 430/138 |
| 5,886,293 | 2/1999 | Nomura et al. | 430/138 |
| 5,925,489 | 7/1999 | Kawabuchi et al. | 430/138 |

*Primary Examiner*—John S. Chu
*Attorney, Agent, or Firm*—Sughrue, Mion, Zinn, Macpeak & Seas, PLLC

[57] ABSTRACT

Disclosed is a photo- and heat-sensitive recording material comprising a substrate and a photo- and heat-sensitive recording layer formed thereon containing a diazo compound and a coupler, wherein the coupler is a compound represented by the general formula (1) or the general formula (2):

General Formula (1)

General Formula (2)

where $R^1$, $R^2$ and $R^3$ are each independently a hydrogen atom or a substituent group; and $R^1$ and $R^2$ may join with each other to form a ring. The reaction between the coupler represented by the general formula (2) and a specific diazo compound produces a magenta colorant having very sharp absorption characteristics. In short, the present invention provides a photo- and heat-sensitive recording material which does not inhibit the fixing and which exhibits excellent color formation, color reproduction, and image durability. Further, the present invention provides a magenta colorant which exhibits excellent absorption characteristics.

19 Claims, No Drawings

PHOTO- AND HEAT-SENSITIVE RECORDING MATERIAL AND COLORANT PRODUCED FROM THE MATERIAL

BACKGROUND OF THE INVENTION

1. Field of the Invention

The present invention relates to a photo- and heat-sensitive recording material using a diazo compound and a coupler as color forming components. More specifically, the present invention relates to a photo- and heat-sensitive recording material which does not inhibit the fixing and which exhibits excellent color formation, color reproduction, and image durability. Further, the present invention relates to a magenta colorant which is produced from the foregoing material and which exhibits excellent absorption characteristics.

2. Description of the Related Art

A diazo compound is a compound having a very high chemical activity. Because of this chemical activity, a diazo compound easily forms an azo dye by reacting with a phenol derivative or a compound having an active methylene group, i.e., a so-called coupler. In addition, a diazo compound has a photosensitivity and loses its activity when irradiated with light.

Because of these properties, a diazo compound has been long utilized as a photosensitive recording material represented by diazo copy ("Fundamentals of Photographic Engineering—non-silver salt photography—" edited by the Photographic Society of Japan, 1982, pp.89–117, pp.182–201, published by Corona Publishing Co., Ltd.).

Further, by utilizing the property that a diazo compound is decomposed by light and loses its activity, recently it is also used in a recording material which requires the fixing of images. A typical example of this recording material proposed is a photo-fixing type heat sensitive recording material in which a diazo compound and a coupler are heated in accordance with an image signal so as to form an image by the reaction therebetween and the image thus formed is then fixed by the irradiation of light (for example, H. Sato et al., Journal of the Image Electronics Society of Japan, Vol. 11(1982), No. 4, pp.290–296).

These recording materials utilizing a diazo compound as an color forming element, however, has been associated with a drawback that the shelf life as a recording material is short, because the activity of the diazo compound is so high that the diazo compound undergoes a gradual thermal decomposition even in a dark place and the reactivity of the diazo compound is lost.

A variety of methods have been proposed to improve the instability of the diazo compound. One of the most effective means consists of the process wherein the diazo compound is enclosed in microcapsules.

Since such an encapsulation separates the diazo compound from a compound which accelerates the decomposition of the diazo compound, such as water and a base, the decomposition of the diazo compound is significantly inhibited. Therefore, the shelf life of the recording material using these microcapsules is remarkably improved (T. Usami et al., Journal of the Electrophotographic Society of Japan, Vol. 26(1987), No. 2, pp.115–125).

A generally adopted method for enclosing a diazo compound in microcapsules comprises the steps of dissolving a diazo compound in a hydrophobic solvent (oil phase), and adding the resulting solution into an aqueous solution (aqueous phase) containing a water-soluble polymer dissolved therein in order to emulsify the oil phase in the aqueous phase by means of, for example, a homogenizer, wherein a monomer or a prepolymer designed to form a wall of the microcapsule is added in advance either to the oil phase or to the aqueous phase, or alternatively to both phases so that a polymeric wall is formed by polymerization reaction or deposition of a polymer in the interface between the oil phase and the aqueous phase.

Details of these methods are described in, for example, A. Kondo, "Microcapsules" published by Nikkan Kogyo Shinbun Co., Ltd., 1970, and T. Kondo et al., "Microcapsules" published by Sankyo Publishing Co., Ltd., 1977.

Examples of the materials which can be used for the formation of the wall of the microcapsules include cross-linked gelatin, alginates, cellulosic materials, polyurea, polyurethane, melamine resins, nylon resins, and the like.

If the microcapsules are composed of a wall, such as a urea resin or a urethane resin, having a glass transition temperature which is slightly higher than room temperature, the capsule wall is impermeable to materials at room temperature but permeable to materials at a temperature above the glass transition temperature. Therefore, such microcapsules are called heat-responding microcapsules and are useful in a heat-sensitive recording material.

That is, a recording material comprising a substrate and a photo- and heat-sensitive recording layer formed thereon (the photo- and heat-sensitive recording layer comprises heat-responding microcapsules containing a diazo compound, a coupler, and a base), makes it possible to maintain the diazo compound for a long period of time in a stable state, to easily form a colored image by heating, and to fix the image by the irradiation of light.

This is because, as stated previously, the stability of the diazo compound can be remarkably improved by the encapsulation.

What is required to further improve these photo- and heat-sensitive recording materials includes the reduction of the inhibition of fixing and the improvement of color formation, color reproduction and image durability. For example, although Japanese Patent Application No. 9-152,414 proposes a coumarin derivative and a pyrazolone derivative as couplers to produce a magenta image, the invention described therein does not sufficiently meet the above-mentioned requirements and therefore improvement is needed.

On the other hand, although Japanese Patent Application Laid-Open (JP-A) No. 5-331,381 describes a pyrrolotriazole dye, the dye described therein does not have sufficient absorption characteristics and therefore improvement is still needed.

SUMMARY OF THE INVENTION

A first object of the present invention is to provide a photo- and heat-sensitive recording material which does not inhibit the fixing and which exhibits excellent color formation, color reproduction, and image durability.

A second object of the present invention is to provide a magenta colorant which exhibits excellent absorption characteristics.

The first object of the present invention has been achieved by a photo- and heat-sensitive recording material comprising a substrate and a photo- and heat-sensitive recording layer formed thereon containing a diazo compound and a coupler, wherein the coupler is a compound represented by the general formula (1) or the general formula (2).

General Formula (1)

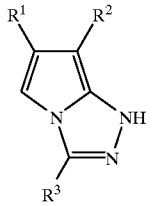

General Formula (2)

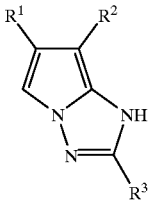

In these formulas, $R^1$, $R^2$ and $R^3$ are each independently a hydrogen atom or a substituent group. $R^1$ and $R^2$ may join with each other to form a ring.

Preferably, the coupler is a compound represented by the general formula (2).

In the photo- and heat-sensitive recording material of the present invention, the diazo compound is preferably a compound having an absorption peak in the range of 380 to 450 nm. More preferably, the diazo compound is a compound represented by the general formula (3).

General formula (3)

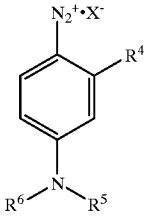

In the formula, $R^4$ is selected from the group consisting of alkylsulfinyl, arylsulfinyl, alkylsulfonyl, arylsulfonyl, sulfamoyl, alkoxycarbonyl, carbamoyl, acyl, and cyano groups; $R^5$ and $R^6$ are each a hydrogen atom, an alkyl group, or an aryl group; and $X^-$ is an negative ion. $R^5$ and $R^6$ may join with each other to form a ring.

Further, in the photo- and heat-sensitive recording material of the present invention, it is preferable that the diazo compound be enclosed in microcapsules. It is more preferable that the capsule wall which encloses the diazo compound be made from polyurethane and/or polyurea.

The second object of the present invention has been achieved by a colorant produced by the photo- and heat-sensitive recording material of the present invention, wherein the colorant is particularly a compound represented by the general formula (4).

General formula (4)

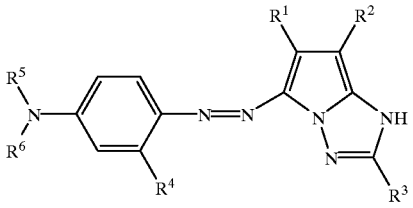

In the formula, $R^1$, $R^2$ and $R^3$ are each independently a hydrogen atom or a substituent group. $R^1$ and $R^2$ may join with each other to form a ring. $R^4$ is selected from the group consisting of alkylsulfinyl, arylsulfinyl, alkylsulfonyl, arylsulfonyl, sulfamoyl, alkoxycarbonyl, carbamoyl, acyl, and cyano groups; $R^5$ and $R^6$ are each a hydrogen atom, an alkyl group, or an aryl group; and $X^-$ is an negative ion. $R^5$ and $R^6$ may join with each other to form a ring.

DESCRIPTION OF THE PREFERRED EMBODIMENT

The details of the present invention are given below.

First, the detail of the coupler represented by the general formula (1) or (2) will be described.

In the formula, $R^1$, $R^2$ and $R^3$ are each a hydrogen atom or a substituent group. Examples of the substituent group include halogen atoms, alkyl, aryl, heterocyclic, cyano, hydroxyl, nitro, carboxyl, sulfo, amino, alkoxy, aryloxy, acylamino, alkylamino, anilino, ureido, sulfamoylamino, alkylthio, arylthio, alkoxycarbonylamino, sulfonamide, carbamoyl, sulfamoyl, sulfonyl, alkoxycarbonyl, heterocycloxy, azo, acyloxy, carbamoyloxy, silyloxy, aryloxycarbonylamino, imido, heterocyclothio, sulfinyl, phosphonyl, aryloxycarbonyl, acyl, and azolyl groups. These groups may be further substituted with the substituent groups enumerated above.

More specifically, $R^1$, $R^2$ and $R^3$ are each a group selected from the group consisting of a hydrogen atom, halogen atoms (such as chlorine and bromine), alkyl groups (such as normal or branched alkyl groups having 1 to 32 carbon atoms, aralkyl groups, alkenyl groups, alkynyl groups, cycloalkyl groups, and cycloalkenyl groups, e.g., methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxydridecyl, trifluoromethyl, cyclopentyl, and 3-(2,4-di-t-amylphenoxy)propyl), aryl groups (e.g., phenyl, 4-t-butylphenyl, 2,4-di-t-amylphenyl, and 4-tetradecaneamidophenyl), heterocyclic groups (such as 2-furyl, 2-thienyl, 2-pyrimidinyl, and 2-benzothiazolyl), cyano groups, hydroxyl groups, nitro groups, carboxyl groups, amino groups, alkoxy groups (e.g., methoxy, ethoxy, 2-methoxyethoxy, 2-dodecylethoxy, and 2-methanesulfonylethoxy), aryloxy groups (e.g., phenoxy, 2-methylphenoxy, 4-t-butylphenoxy, 3-nitrophenoxy, 3-t-butyloxycarbamoylphenoxy, and 3-methoxycarbamoyl), acylamino groups (e.g., acetamido, benzamido, tetradecaneamido, 2-(2,4-di-t-amylphenoxy)butaneamido, 4-(3-t-butyl-4-hydroxyphenoxy)butaneamido, and 2-[4-(4-hydroxyphenylsulfonyl)phenoxy]decaneamido), alkylamino groups (e.g., methylamino, butylamino, dodecylamino, diethylamino, and methylbutylamino), anilino groups (e.g., phenylamino, 2-chloroanilino, 2-chloro-5-tetradecaneaminoanilino, 2-chloro-5-dodecyloxycarbonylanilino, N-acetylanilino, 2-chloro-5-{2-

(3-t-butyl-4-hydroxyphenoxy)dodecaneamido}anilino), ureido groups (e.g., phenylureido, methylureido, and N,N-dibutylureido), sulfamoylamino groups (e.g., N,N-dipropylsulfamoylamino and N-methyl-N-decylsulfamoylamino), alkylthiogroups (e.g. emethylthio, octylthio, tetradecylthio, 2-phenoxyethylthio, 3-phenoxypropylthio, and 3-(4-t-butylphenoxy)propylthio), arylthio groups (e.g., phenylthio, 2-butoxy-5-t-octylphenylthio, 3-pentadecylphenylthio, 2-carboxyphenylthio, and 4-tetradecaneamidophenylthio), alkoxycarbonylamino groups (e.g., methoxycarbonylamino and tetradecyloxycarbonylamino), sulfonamido groups (e.g., methanesulfonamido, hexadecanesulfonamido, benzenesulfonamido, p-toluenesulfonamido, octadecanesulfonamido, and 2-methoxy-5-t-butylbenzenesulfonamido), carbamoyl groups (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), sulfamoyl groups (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), sulfonyl groups (e.g., methanesulfonyl, octanesulfonyl, benzenesulfonyl, and toluenesulfonyl), alkoxycarbonyl groups (e.g., methoxycarbonyl, butyloxycarbonyl, dodecyloxycarbonyl, and octadecyloxycarbonyl), heterocycloxy groups (e.g., 1-phenyltetrazole-5-oxy and 2-tetrahydropyranyloxy), azo groups (e.g., phenylazo, 4-methoxyphenylazo, 4-pivaloylaminophenoxyazo, and 2-hydroxy-4-propanoylphenylazo), acyloxy groups (e.g., acetoxy), carbamoyloxy groups (e.g., N-methylcarbamoyloxy and N-phenylcarbamoyloxy), silyloxygroups (e.g., trimethylsilyloxy and dibutylmethylsilyloxy), aryloxycarbonylamino groups (e.g., phenoxycarbonylamino), imido groups (e.g., N-succinimido, N-phthalimido, and 3-octadecenylsuccinimido), heterocyclothio groups (e.g., 2-benzothiazolylthio, 2,4-di-phenoxy-1,3,5-triazole-6-thio, and 2-pyridylthio), sulfinyl groups (e.g., dodecanesulfinyl, 3-pentadecylphenylsulfinyl, and 3-phenoxypropylsulfinyl), phosphonyl groups (e.g., phenoxyphosphonyl, octyloxyphosphonyl, and phenylphosphonyl), aryloxycarbonyl groups (e.g., phenoxycarbonyl), acyl groups (e.g., acetyl, 3-phenylpropanoyl, benzoyl, and 4-dodecyloxybenzoyl), and azolyl groups (e.g., imidazolyl, pyrazolyl, 3-chloropyrazole-1-yl, and triazolyl).

It is preferable that $R^1$ and $R^2$ be each an electron withdrawing group having $\sigma_p$ of 0.20 or more. Further, it is preferable that the sum of $\sigma_p$ of $R^1$ and $R^2$ be 0.65 or more.

More preferably, the sum of $\sigma_p$ of $R^1$ and $R^2$ is 0.70 or more, and the upper limit of the sum is about 1.8.

Preferably, $R^1$ and $R^2$ are each an electron withdrawing group whose Hammett's constant of substitution $\sigma_p$ is 0.20 or more. More preferably, the constant is 0.30 or more, and the upper limit is 1.0 or less. The Hammett's rule is an empirical rule proposed by L. P. Hammett in 1935 to quantitatively discuss the influence of a substituent group on the reaction or equilibrium of a benzene derivative. Presently, the appropriateness of this rule is widely recognized. There are $\sigma_p$ and $\sigma_m$ as constants of substitution obtained by the Hammett's rule. These constants are described in many common books. For example, details of these constants are described in "Lange's Handbook of Chemistry", edited by J. A. Dean, 12 th edition, 1979 (McGraw-Hill), and "Extra issue of Kagakuno Ryoiki", No. 122, pp.96–103, 1979 (Nankodo Publishing Co., Ltd.). In the present invention, $R^1$ and $R^2$ are preferably defined by Hammett's constant of substitution $\sigma_p$. However, it must be noted that $R^1$ and $R^2$ are not necessarily limited to the substituent groups having Hammett's constants known and described in these books and that any substituent groups may be selected as $R^1$ and $R^2$ of the present invention, even if their Hammett's constants are not described in these books, as long as they each fall within the above-described range when measured based on the Hammett's rule.

Preferred examples of the $R^1$ and $R^2$ which are each an electron withdrawing group having a Hammett's constant $\sigma_p$ of 0.20 or more include acyl groups, acyloxy groups, carbamoyl groups, alkoxycarbonyl groups, aryloxycarbonyl groups, cyano groups, nitro groups, dialkylphosphono groups, diarylphosphono groups, diarylphosphinyl groups, alkylsulfinyl groups, arylsulfinyl groups, alkylsulfonyl groups, arylsulfonyl groups, sulfonyloxy groups, acylthio groups, sulfamoyl groups, thiocyanate groups, thiocarbonyl groups, halogenated alkyl groups, halogenated alkoxy groups, halogenated aryloxy groups, halogenated alkylamino groups, halogenated alkylthio groups, aryl groups substituted with other electron withdrawing groups having a $\sigma_p$ value of 0.20 or more, heterocyclic groups, halogen atoms, azo groups, and selenocyanate groups. Among these substituent groups, the substituent group capable of having additional substituent groups may further have substituents like those above exemplified by $R^3$.

The above-mentioned groups are further described in detail. Examples of the electron withdrawing group having a $\sigma_p$ value of 0.20 or more include acyl groups (e.g., acetyl, 3-phenylpropanoyl, benzoyl, and 4-dodecyloxybenzoyl), acyloxy groups (e.g., acetoxy), carbamoyl groups (e.g., carbamoyl, N-ethylcarbamoyl, N-phenylcarbamoyl, N,N-dibutylcarbamoyl, N-(2-dodecyloxyethyl)carbamoyl, N-(4-n-pentadecaneamido)phenylcarbamoyl, N-methyl-N-dodecylcarbamoyl, and N-{3-(2,4-di-t-amylphenoxy)propyl}carbamoyl), alkoxycarbonyl groups (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, and octadecyloxycarbonyl), aryloxycarbonyl groups (e.g., phenoxycarbonyl), cyano groups, nitro groups, dialkylphosphono groups (e.g., dimethylphosphono), diarylphosphono groups (e.g., diphenylphosphono), diarylphosphinyl groups (e.g., diphenylphosphinyl), alkylsulfinyl groups (e.g., 3-phenoxypropylsulphinyl), arylsulfinyl groups (e.g., 3-pentadecylphenylsulphinyl), alkylsulfonyl groups (e.g., methanesulfonyl and octanesulfonyl), arylsulfonyl groups (e.g., benzenesulfonyl and toluenesuofonyl), sulfonyloxy groups (e.g., methane sulfonyloxy and toluenesulfonyloxy), acylthio groups (e.g., acetylthio and benzoylthio), sulfamoyl groups (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), thiocyanate groups, thiocarbonyl groups (e.g., methylthiocarbonyl and phenylthiocarbonyl), halogenated alkyl groups (e.g., trifluoromethane and heptafluoropropane), halogenated alkoxy groups (e.g., trifluoromethyloxy), halogenated aryloxy groups (e.g., pentafluorophenyloxy), halogenated alkylamino groups (e.g., N,N-di-(trifluoromethyl)amino), halogenated alkylthio groups (e.g., difluoromethylthio and 1,1,2,2-tetrafluoroethylthio), aryl groups substituted with other electron withdrawing groups having a $\sigma_p$ value of 0.20 or more (e.g., 2,4-dinitrophenyl, 2,4,6-trichlorophenyl, and pentachlorophenyl), heterocyclic groups (e.g., 2-benzoxazolyl, 2-benzothiazolyl, 1-phenyl-2-benzimidadolyl, 5-chloro-1-tetrazolyl, and 1-pyrrolyl), halogen atoms (e.g., chlorine and bromine), azo groups (e.g., phenylazo), and selenocyanate groups. Among these substituent groups, the substituent group capable of having additional substituent groups may further have substituents like those above exemplified by $R^3$.

More preferred examples of the $R^1$ and $R^2$ include acyl groups, acyloxy groups, carbamoyl groups, alkoxycarbonyl groups, aryloxycarbonyl groups, cyano groups, nitro groups, alkylsulfinyl groups, arylsulfinyl groups, alkylsulfonyl groups, arylsulfonyl groups, sulfamoyl groups, halogenated alkyl groups, halogenated alkyloxy groups, halogenated alkylthio groups, halogenated aryloxy groups, aryl groups substituted with two or more other electron withdrawing groups each having a $\sigma_p$ value of 0.20 or more, and heterocyclic groups. Furthermore preferred examples of the $R^1$ and $R^2$ include alkoxycarbonyl groups, nitro groups, cyano groups, arylsulfonyl groups, carbamoyl groups, and halogenated alkyl groups. The most preferred as $R^1$ is a cyano group. Particularly preferred as $R^2$ is an alkoxycarbonyl group. The most preferred as $R^2$ is a branched alkoxycarbonyl group.

Preferred examples of $R^3$ include alkyl groups, aryl groups, heterocyclicgroups, acylaminogroups, anilinogroups, ureido groups, sulfamoylamino groups, alkylthio groups, arylthio groups, alkoxycarbonylamino groups, sulfonamido groups, carbamoyl groups, heterocycloxy groups, acyloxy groups, carbamoyloxy groups, aryloxycarbonylamino groups, imido groups, heterocyclothio groups, sulfinyl groups, phosphonyl groups, aryloxycarbonyl groups, and azolyl groups. More preferred examples of $R^3$ are alkyl groups and aryl groups. The most preferred example of $R^3$ is an aryl group having an electron donating group.

The molecular weight of the coupler is preferably in the range of 300 to 900, more preferably in the range of 350 to 800, and most preferably in the range of 400 to 700.

Specific example of the couplers represented by the general formula (1) or (2) of the present invention are given below. However, it must be noted that the present invention is not limited to these examples. The groups hereinafter denoted by Me, Et, (i)Pr, Pr(i), Bu, (t)Bu, Bu(t), and Ph, respectively, in chemical formulas are represented by the formulas given below.

Me = $-CH_3$

Et = $-CH_2CH_3$ (i)Pr = Pr(i) = $-CH(CH_3)CH_3$

Bu = $-CH_2CH_2CH_2CH_3$ (t)Bu = Bu(t) = $-C(CH_3)_3$

Ph = 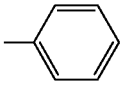

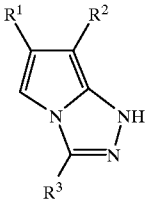

| | $R^1$ | $R^2$ | $R^3$ |
|---|---|---|---|
| K-1 | Ph | CN | (i)$P_r$ |
| K-2 | Ph | CN | Ph |
| K-3 | $-CO_2Et$ | CN | 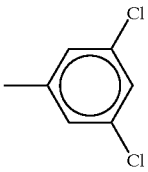 |
| K-4 | Me | Me | 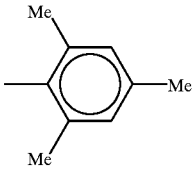 |
| K-5 | CN | CN | Bu(t) |

-continued
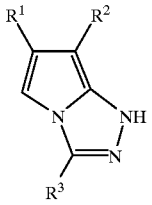
| | $R^1$ | $R^2$ | $R^3$ |
|---|---|---|---|
| K-6 | 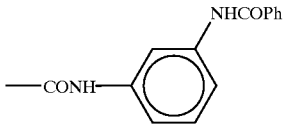  | $CF_3$ | 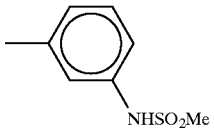  |
| K-7 | —$SO_2Ph$ | CN | 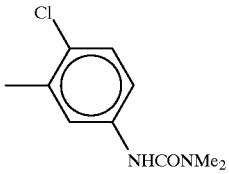  |
| K-8 | —COMe | COMe | Ph |
| K-9 | 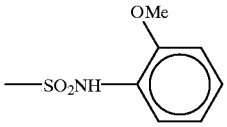  | —$CO_2Et$ | 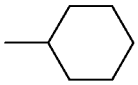 |
| K-10 | 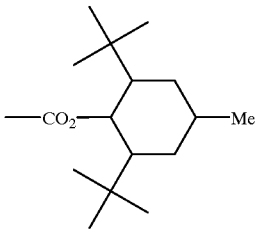  | CN | 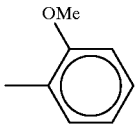  |
| K-11 | CN | CN | 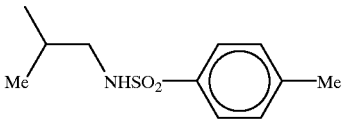  |
| K-12 | CN | 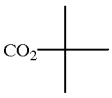  | 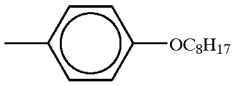  |

-continued
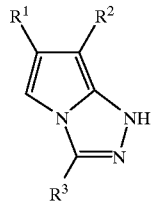
| | $R^1$ | $R^2$ | $R^3$ |
|---|---|---|---|
| K-13 | CN | $CO_2Et$ | 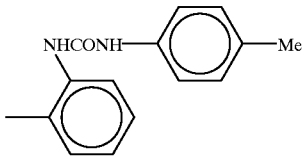  |
| K-14 | —COMe | 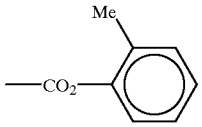  | 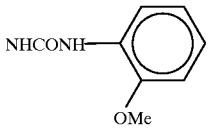  |
| K-15 | 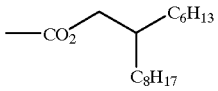  | $SO_2Me$ | 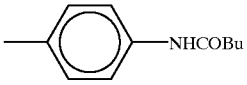  |
| K-16 | CN | 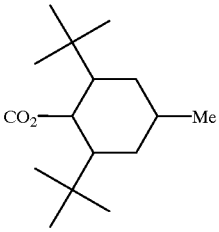  | 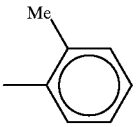  |
| K-17 | —CONHPh | 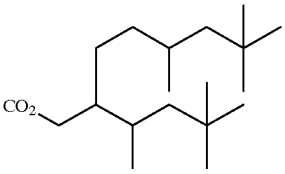  | Bu(t) |
| K-18 | Ph | Me | $CO_2Bu$ |
| K-19 | SOPh | $CF_3$ | $C_8H_{17}$ |

-continued
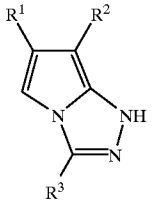
| | $R^1$ | $R^2$ | $R^3$ |
|---|---|---|---|
| K-20 | CN | 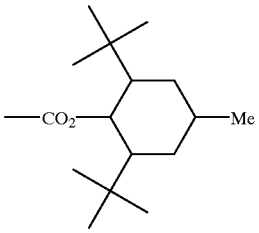  | 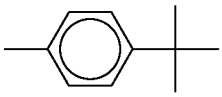 |
| K-21 | CN | 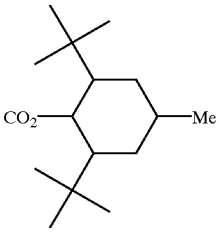  | 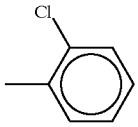  |
| K-22 | $SO_2Ph$ | $CO_2Me$ | 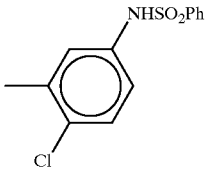  |
| K-23 | CN | COPh | 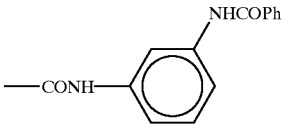  |
| K-24 | Me | Me | 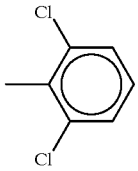  |
| K-25 | CN | 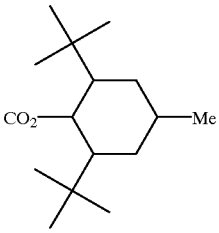  | 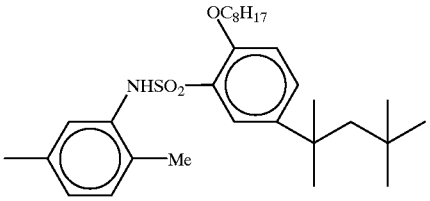  |

-continued
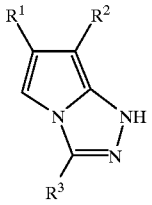
| | $R^1$ | $R^2$ | $R^3$ |
|---|---|---|---|
| K-26 | CONHPh | 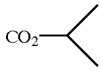 | Pr(i) |
| K-27 | CN | 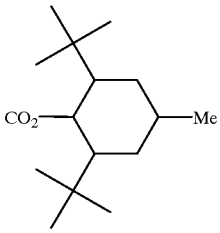 | 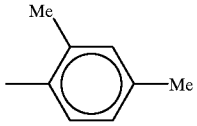 |
| K-28 | CN | $CO_2Et$ | 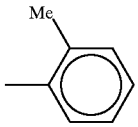 |
| K-29 | CN | 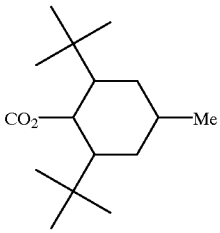 | 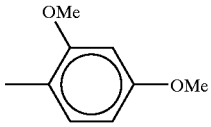 |
| K-30 | $COC_5H_{11}$ | $CF_3$ | 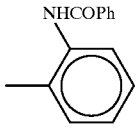 |
| K-31 | CN | 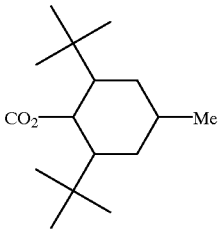 | 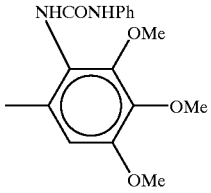 |
| K-32 | $CO_2Et$ | $CO_2Et$ | 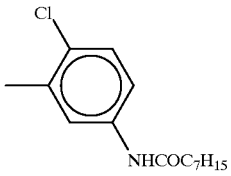 |

-continued
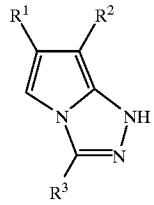
| | $R^1$ | $R^2$ | $R^3$ |
|---|---|---|---|
| K-33 | CN | 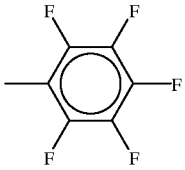 | SPr(i) |
| K-34 | CN | 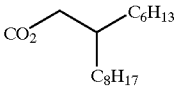 | 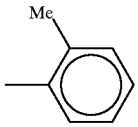 |
| K-35 | 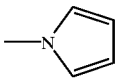 | 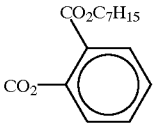 | 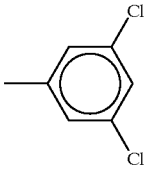 |
| K-36 | CN | 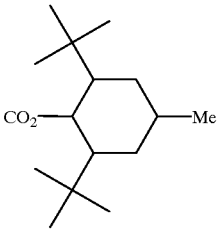 | 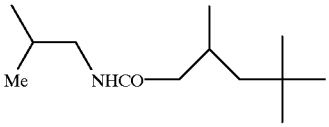 |
| K-37 | $CF_3$ | 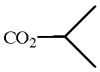 | 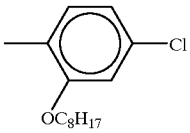 |
| K-38 | CN | 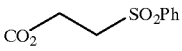 | 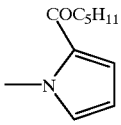 |
| K-39 | $CF_3$ | $—SO_2NHPh$ | $—CH_2CH_2NHCOPh$ |
| K-40 | (t)Bu | 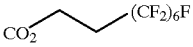 | Me |

The couplers of the present invention can be synthesized by the processes described in JP-A Nos. 5-204,107, 5-313,324, 6-172,357 and 6-347,960, or by similar processes. Examples of the synthetic process are given below.

Synthesis example of a coupler (K-16)

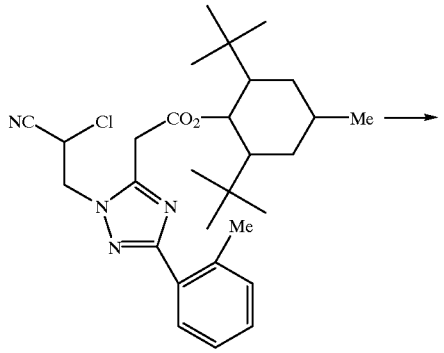

K-16a

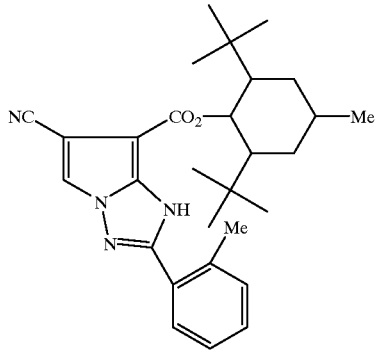

K-16

1.18 g of the compound (K-16a) was dissolved in 20.0 ml of THF. Then, 0.84 g of pyridinium tribromide was added to the solution. The solution was stirred at room temperature for 3 hours. Upon completion of the reaction, to the reaction solution was added 10.0 ml of an aqueous solution containing 0.20 g of sodium thiosulfate. The mixture was then extracted with ethyl acetate. The extract was washed with water, and thereafter dried by using $MgSO_4$. After removal of the solvent from the solution at a reduced pressure, 50.0 ml of $CH_2Cl_2$ was added to the residue and the solution was ice-cooled. Then, 1.3 ml of tetramethylguanidine was added dropwise to the solution, and the solution was stirred at room temperature for 2 hours. Upon completion of the reaction, a dilute aqueous solution of hydrochloric acid was added to the reaction solution. The mixture was then extracted with $CH_2Cl_2$. The extract was washed with water, and thereafter dried by using $MgSO_4$. After removal of the solvent from the solution at a reduced pressure, the residue was purified by means of silica gel column chromatography. In this way, 0.27 g of the target product (K-16) was obtained.

The coupler of the present invention is designed to undergo a coupling reaction with a diazo compound to form a colorant in an basic environment and/or a neutral environment. According to purposes such as color adjustment, the coupler of the present invention can be used together with a known coupler.

Examples of the couplers which can be used together with the coupler of the present invention include a so-called active methylene compound having a methylene group adjacent to a carbonyl group, a phenol derivative, and a naphthol derivative. The compounds exemplified below can be used in so far as these compounds meet the purpose of the present invention.

Particularly preferred examples of the couplers which can be used together with the coupler of the present invention include resorcinol, phloroglucin, 2,3-dihydroxynaphthalene, sodium 2,3-dihydroxynaphthalene-6-sulfonate, 1-hydroxy-2-naphthoic acid morpholino propylamide, sodium 2-hydroxy-3-naphthalenesulfonate, 2-hydroxy-3-naphthalenesulfoneanilide, 2-hydroxy-3-naphthalenesulfonic acid morpholino propylamide, 2-hydroxy-3-naphthalenesulfonic acid 2-ethylhexyloxy propylamide, 2-hydroxy-3-naphthalenesulfonic acid-2-ethylhexylamide, 5-acetamido-1-naphthol, sodium 1-hydroxy-8-acetamidonaphthalene-3,6-disulfonate, 1-hydroxy-8-acetamidonaphthalene-3,6-disulfonic acid dianilide, 1,5-dihydroxynaphthalene, 2-hydroxy-3-naphthoic acid morpholino propylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamido-5-pyrazolone, 6-hydroxy-4-methyl-3-cyano-1-(2-ethylhexyl)-2-pyridone, 2,4-bis(benzoylacetamido)toluene, 1,3-bis(pivaloylacetamidomethyl)benzene, benzoylacetonitrile, thenoylacetonitrile, acetoacetanilide, benzoylacetanilide, pivalolylacetanilide, 2-chloro-5-(N-n-butylsulfamoyl)-1-pivaloylacetamidobenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, and 1-(4-n-octyloxyphenyl)-3-tert-butyl-5-aminopyrazole. Details of the couplers are described in, for example, JP-A Nos. 4-201,483, 7-223,367, 7-223,368, 7-323,660, Japanese Patent Application Nos. 5-278,608, 5-297,024, 6-18,669, 6-18,670, 7-316,280, 8-027,095, 8-027,096, 8-030,799, 8-12,610, 8-132,394, 8-358,755, 8-358,756, and 9-069,990.

Next, the details of the compounds represented by the general formula (3) are described.

In the formula, each of the alkylsulfenyl group and the arylsulfenyl group represented by $R^4$ may further have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred are alkylsulfenyl groups having a total of carbon atoms of 1~30 (e.g., methylthio, ethylthio, butylthio, hexylthio, octylthio, dodecylthio, octadecylthio, cyclohexylthio, 2-ethylhexylthio, 2-(N,N-dioctylcarbamoyl)ethylthio), allylthio groups, benzylthio groups, and arylsulfenyl groups having a total of carbon atoms of 6~30 (e.g., phenylthio, 4-methoxyphenylthio, 4-(2-ethylhexyloxy)phenylthio, 2-butoxycarbonylphenylthio, 2-chlorophenylthio, 4-chlorophenylthio, and 4-methylphenylthio).

In the formula, each of the alkylsulfinyl group and the arylsulfinyl group represented by $R^4$ may further have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred are alkylsulfinyl groups having a total of carbon atoms of 1~30 (e.g., methylsulfinyl, ethylsulfinyl, butylsulfinyl, hexylsulfinyl, octylsulfinyl, dodecylsulfinyl, octadecylsulfinyl, cyclohexylsulfinyl, 2-ethylhexylsulfinyl, 2-(N,N-dioctylcarbamoyl) ethylsulfinyl) allylsulfinyl groups, benzylsulfinyl groups, and arylsulfinyl groups having a total of carbon atoms of 6~30 (e.g., phenylsulfinyl, 4-methoxyphenylsulfinyl, 4-(2-ethylhexyloxy)phenylsulfinyl, 2-butoxycarbonylphenylsulfinyl, 2-chlorophenylsulfinyl, 4-chlorophenylsulfinyl, and 4-methylphenylsulfinyl).

In the formula, each of the alkylsulfonyl group and the arylsulfonyl group represented by $R^4$ may further have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred are alkylsulfonyl groups having a total of carbon atoms of 1~30 (e.g., methylsulfonyl, ethylsulfonyl, butylsulfonyl, hexylsulfonyl, octylsulfonyl, dodecylsulfonyl, octadecylsulfonyl, cyclohexylsulfonyl, 2-ethylhexylsulfonyl, 2-(N,N-dioctylcarbamoyl) ethylsulfonyl) allylsulfonyl groups, benzylsulfonyl groups, and arylsulfonyl groups having a total of carbon atoms of 6~30 (e.g., phenyllsulfonyl, 4-methoxyphenylsulfonyl, 4-(2-ethylhexyloxy)phenylsulfonyl, 2-butoxycarbonylphenylsulfonyl, 2-chlorophenylsulfonyl, 4-chlorophenylsulfonyl, and 4-methylphenylsulfonyl).

In the formula, the sulfamoyl group represented by $R^4$ may be unsubstituted or may have a substituent group. The sulfamoyl group is preferably N,N-dialkyl (or aryl) sulfamoyl group having a total of carbon atoms of 3~30, for example, N,N-dimethylsulfamoyl, N,N-diethylsulfamoyl, N,N-dibutylsulfamoyl, N,N-dioctylsulfamoyl, N,N-bis(2-ethylhexyl)sulfamoyl, N-ethyl-N-benzylsulfamoyl, N-ethyl-N-butylsulfamoyl, piperidinosulfonyl, pyrrolidinosulfonyl, morpholinosulfonyl, 4-octanoylpiperadinosulfonyl, and hexamethyleneiminosulfonyl.

In the formula, the alkoxycarbonyl group represented by $R^4$ may be unsubstituted or may have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred are alkoxycarbonyl groups having a total of carbon atoms of 2~30, for example, methoxycarbonyl, ethoxycarbonyl, butoxycarbonyl, octyloxycarbonyl, dodecyloxycarbonyl, cyclohexyloxycarbonyl, octadecyloxycarbonyl, 2-ethoxyethoxycarbonyl, 2-chloroethoxycarbonyl, 2-phenoxyethoxycarbonyl, and benzyloxycarbonyl.

In the formula, the carbamoyl group represented by $R^4$ may be unsubstituted or may have a substituent group. The carbamoyl group is preferably an N,N-dialkyl(or aryl) carbamoyl group, wherein the alkyl (or aryl) group may be unsubstituted or may have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred is an N,N-dialkyl(or aryl) carbamoyl group having a total of carbon atoms of 3~30, for example, N,N-dimethylcarbamoyl, N,N-diethylcarbamoyl, N,N-dibutylcarbamoyl, N,N-dioctylcarbamoyl, N,N-bis(2-ethylhexyl)carbamoyl, N-ethyl-N-benzylcarbamoyl, N-ethyl-N-butylcarbamoyl, piperidinocarbonyl, pyrrolidinocarbonyl, morpholinocarbonyl, 4-octanoylpiperadinocarbonyl, and hexamethyleneiminocarbonyl.

In the formula, the acyl group represented by $R^4$ is preferably an aliphatic acyl group, an aromatic acyl group, or a heterocyclic acyl group. The acyl group may be unsubstituted or may have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred is an acyl group having a total of carbon atoms of 2~30, for example, acetyl, butanoyl, octanoyl, benzoyl, 4-methoxybenzoyl, and 4-chlorobenzoyl.

In the formula, the alkyl group represented by $R^5$ or $R^6$ may be unsubstituted or may have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred is an alkyl group having a total of carbon atoms of 1~30, for example, methyl, ethyl, butyl, octyl, 2-ethylhexyl, decyl, dodecyl, octadecyl, 2-hydroxyethyl, 2-benzoyloxyethyl, 2-(4-butoxyphenoxy) ethyl, benzyl, and 4-methoxybenzyl.

In the formula, the aryl group represented by $R^5$ or $R^6$ may be unsubstituted or may have a substituent group. Preferred examples of the substituent group include phenyl groups, halogen atoms, alkoxy groups, aryloxy groups, alkoxycarbonyl groups, acyloxy groups, acylamino groups, carbamoyl groups, cyano groups, alkylsulfenyl groups, arylsulfenyl groups, alkylsulfinyl groups, arylsulfinyl groups, alkylsulfonyl groups, arylsulfonyl groups, sulfonamide groups, sulfamoyl groups, carboxyl groups, sulfonic acid groups, acyl groups, and heterocyclic groups.

Particularly preferred is an aryl group having a total of carbon atoms of 6~30, for example, phenyl, 4-methoxyphenyl, and 4-chlorophenyl.

When $R^5$ and $R^6$ join with each other to form a ring, the ring thus formed is preferably a 5- to 7-(membered) ring.

When $R^5$ and $R^6$ join with each other to form a nitrogen-containing heterocyclic ring, the ring thus formed is preferably a 5- to 7-(membered) ring. Preferred examples of the ring are pyrrolidino, piperidino, morpholino, 4-acylpiperadino, 4-sulfonylpiperadino and hexamethyleneimino.

Further, $R^5$ and $R^6$ each may be a substituent group having a diazoniophenyl group as a substituent group, and may produce a multi-substituent group form equal to or larger than a bis-form.

$X^-$ stands for a negative ion which is an inorganic ion or an organic ion. Preferred examples of the inorganic ion include a hexafluorophosphate ion, a hydrofluoroborate ion, a chloride ion, and a sulfate ion, particularly preferred being a hexafluorophosphate ion and a hydrofluoroborate ion. Preferred examples of the organic ion include a polyfluoroalkylcarboxylate ion, a polyfluoroalkylsulfonate ion, a tetraphenylborate ion, an aromatic carboxylate ion, and an aromatic sulfonate ion.

Specific example of the diazo compounds represented by the general formula (3) of the present invention are given below. However, it must be noted that the present invention is not limited to these examples.

A-1

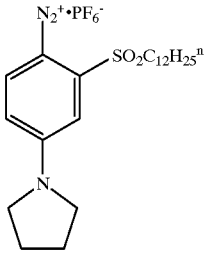

A-2

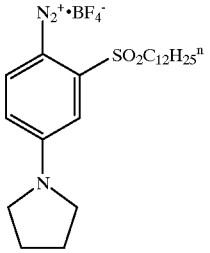

A-3

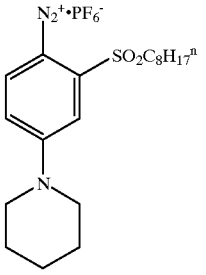

-continued

A-4

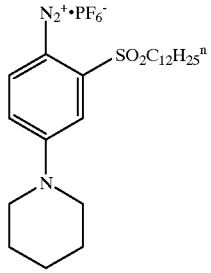

A-5

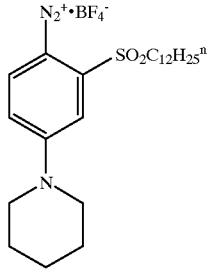

A-6

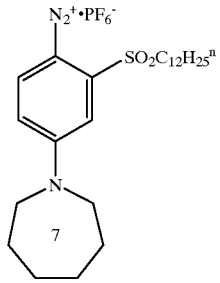

A-7

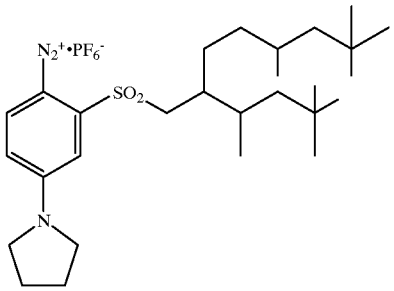

A-8

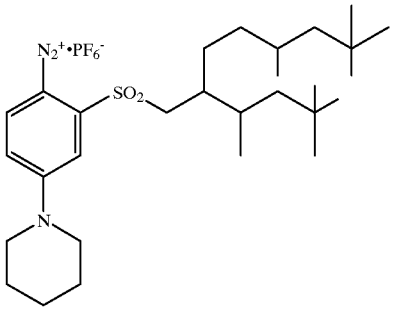

-continued
A-9
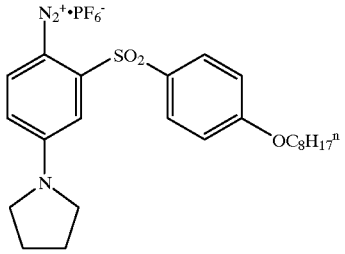
A-10
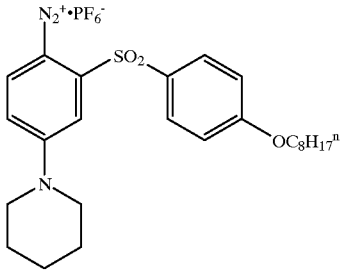
A-11
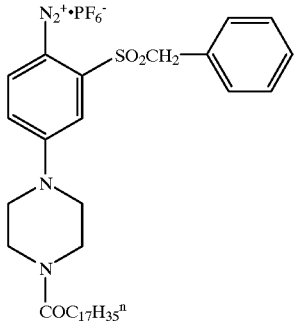
A-12
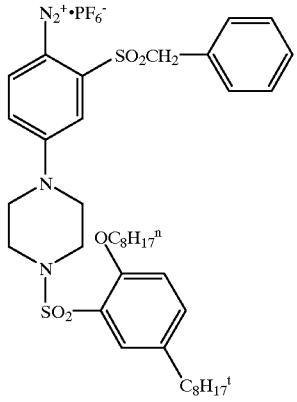
A-13
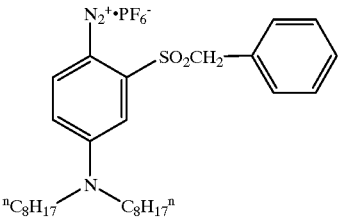
-continued
A-14
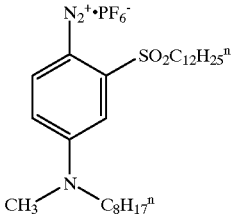
A-15
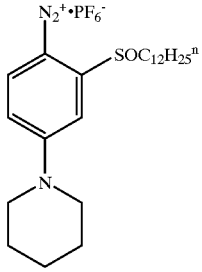
A-16
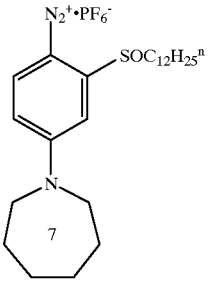
A-17
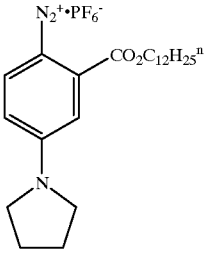
A-18
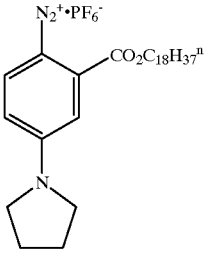
A-19
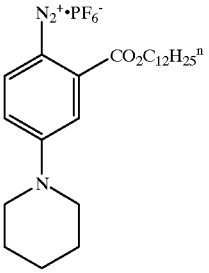

-continued
A-20
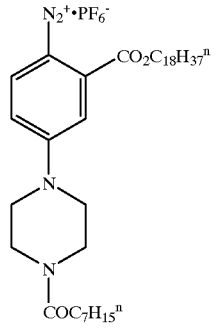
A-21
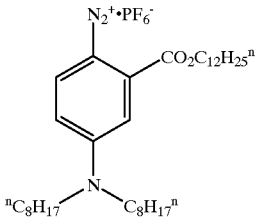
A-22
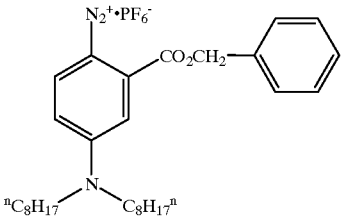
A-23
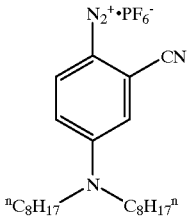
A-24
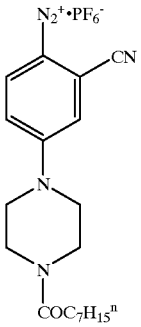
A-25
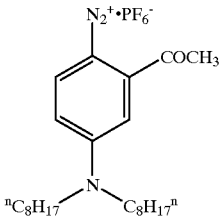
-continued
A-26
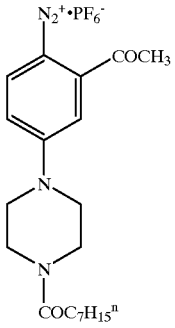
A-27
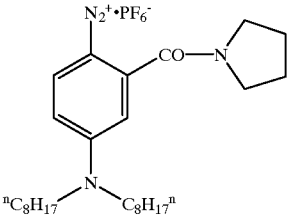
A-28
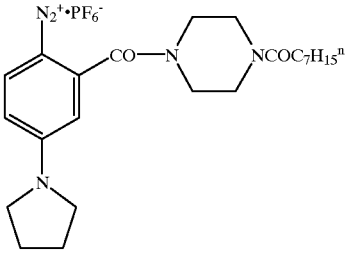
A-29
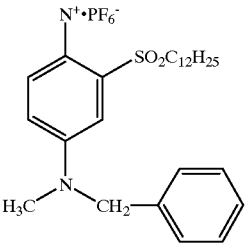
A-30
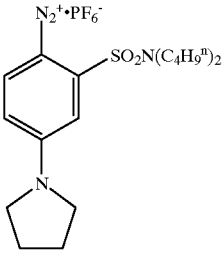
A-31
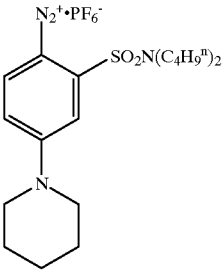

-continued

A-32

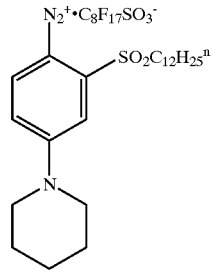

A-33

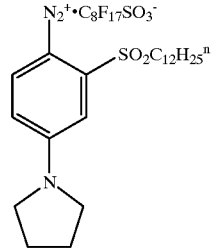

A-34

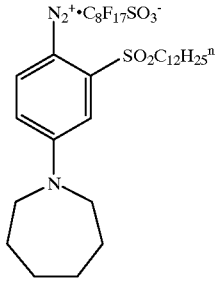

A-35

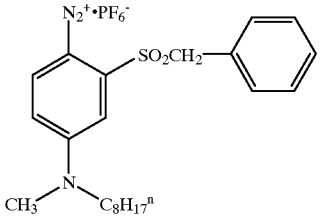

A-36

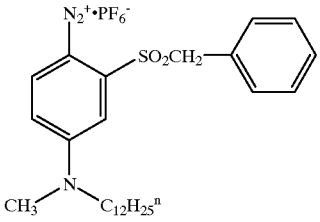

A-37

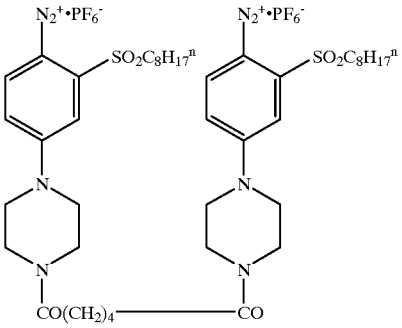

-continued

A-38

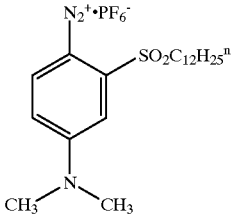

A-39

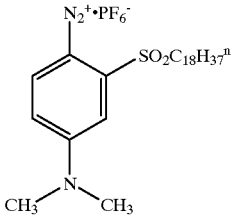

The diazo compounds represented by the general formula (3) can be prepared by a known process or by the process described in Japanese Patent Application No. 9-152,414, or by similar processes. That is, the diazo compounds represented by the general formula (3) can be obtained by diazotizing a corresponding aniline in an acidic solvent by using sodium nitrite, nitrosyl sulfate, or isoamyl nitrite.

The compound represented by the general formula (3) may be an oily compound or a crystalline compound. However, because of ease in handling, a crystalline compound is more preferred.

The compounds represented by the general formula (3) may be used singly or in a combination of two or more.

When used in a photo- and heat-sensitive recording material, the amount of the compound represented by the general formula (3) is preferably in the range of 0.02 to 5 $g/m^2$, and more preferably in the range of 0.1 to 4 $g/m^2$, in the photo- and heat-sensitive recording layer, from the standpoint of the density of the color formed.

In order to curb reactivity of the diazo compound, a complex compound may be formed by using zinc chloride, cadmium chloride, or tin chloride. These diazo compounds can be used singly or in a combination of two or more. Further, according to purposes such as color adjustment, the diazo compound represented by the general formula (3) may be used together with a known diazo compound. Details of known diazo compounds are described in, for example, Japanese Patent Application Publication (JP-B) No. 5-33,676, JP-A Nos. 4-59,287, 8-156,417, 1-80,588, 4-59,288, and 6-328,853, Japanese Patent Application Nos. 8-224,252 and 7-121,208.

Among the colorants which are formed as a result of coupling between the couplers and the diazo compounds in the photo- and heat-sensitive recording material of the present invention, the colorants represented by the general formula (4) are specifically described below. However, the invention must be noted that the present invention is not limited to these colorants.

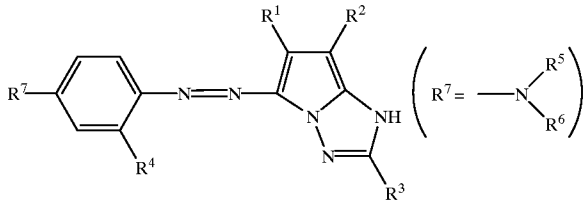
| M | $R^1$ | $R^2$ | $R^3$ | $R^4$ | $R^7$ |
|---|---|---|---|---|---|
| 1 | —CN | 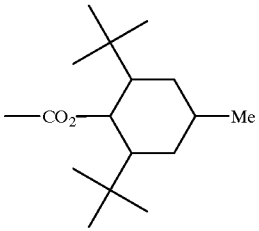 | 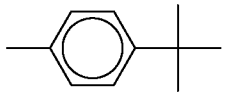 | $—SO_2C_{12}H_{25}$ | 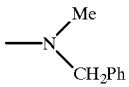 |
| 2 | $—SO_2Ph$ | $—CF_3$ | 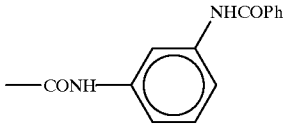 | $—CO_2C_{12}H_{25}$ | 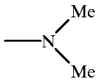 |
| 3 | $—CF_3$ | $—SO_2NHPh$ | 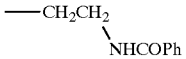 | $—SO_2C_{12}H_{25}$ | 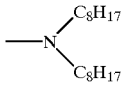 |
| 4 | —CN | 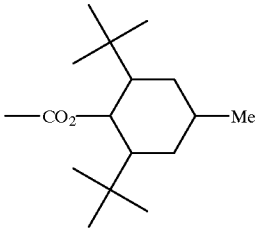 | 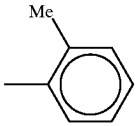 | $—SO_2C_{12}H_{25}$ | 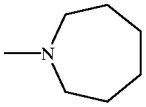 |

-continued
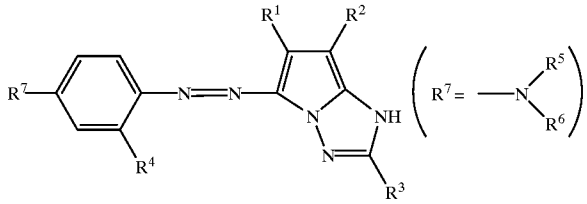
| M | $R^1$ | $R^2$ | $R^3$ | $R^4$ | $R^7$ |
|---|---|---|---|---|---|
| 5 | —CN | 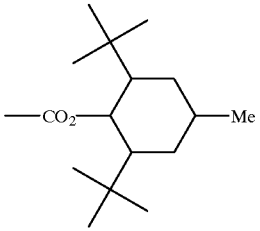 | 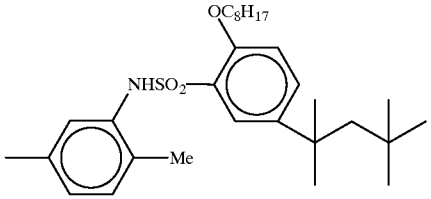 | $—SO_2C_{12}H_{25}$ | 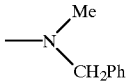 |
| 6 | $—COC_5H_{11}$ | 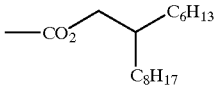 | 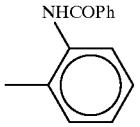 | 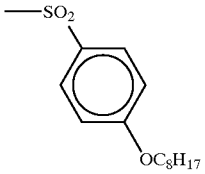 | 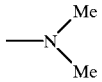 |
| 7 | —CN | —COPh | 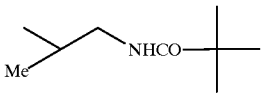 | $—CO_2—CH_2Ph$ | 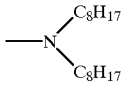 |

-continued
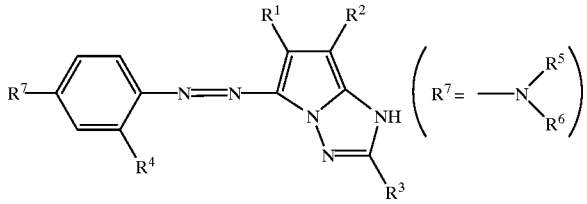
| M | $R^1$ | $R^2$ | $R^3$ | $R^4$ | $R^7$ |
|---|---|---|---|---|---|
| 8 | —CN | 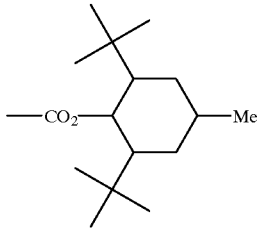 | 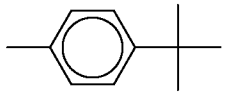 | $—SO_2C_{12}H_{25}$ | 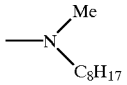 |
| 9 | —Me | —Me | 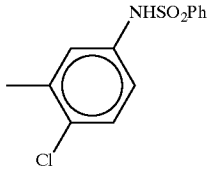 | 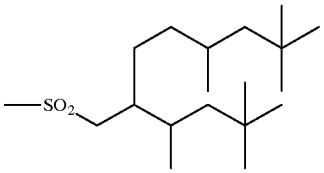 | 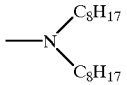 |
| 10 | $—CO_2Et$ | $—CO_2Et$ | 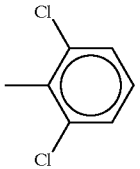 | $—SO_2N(Bu)_2$ | 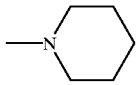 |

-continued
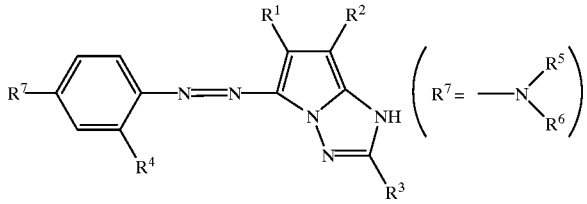
| M | $R^1$ | $R^2$ | $R^3$ | $R^4$ | $R^7$ |
|---|---|---|---|---|---|
| 11 | —CN | 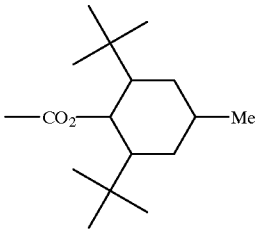 | 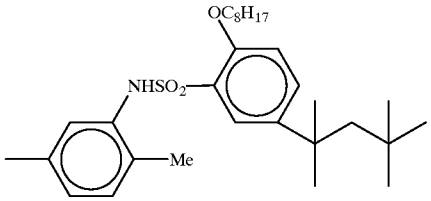 | $—SO_2C_{12}H_{25}$ | 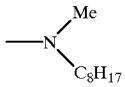 |
| 12 | —CN | 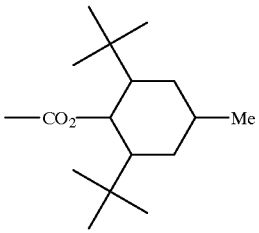 | 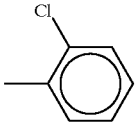 | $—SO_2C_{12}H_{25}$ | 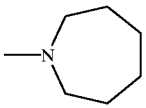 |
| 13 | —CONHPh | $—CF_3$ | 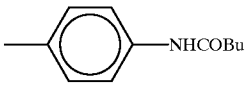 | $—CO_2C_{18}H_{37}$ | 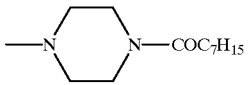 |
| 14 | 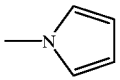 | 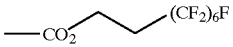 | —Me | $—SO_2C_{12}H_{25}$ | 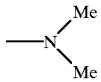 |

-continued
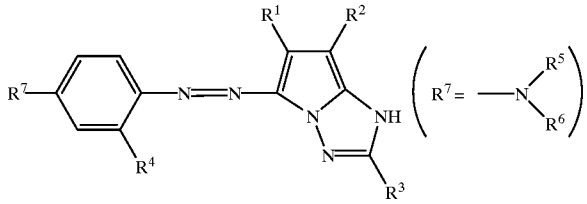
| M | $R^1$ | $R^2$ | $R^3$ | $R^4$ | $R^7$ |
|---|---|---|---|---|---|
| 15 | —COMe | 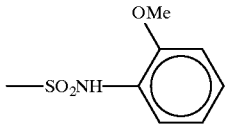 | 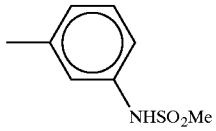 | —COMe | 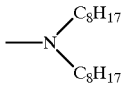 |
| 16 | —CN | 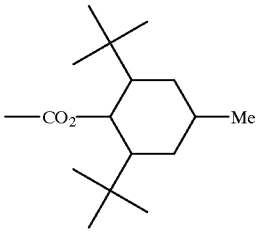 | 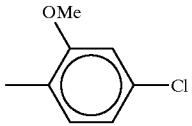 | $—SO_2C_{12}H_{25}$ | 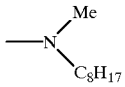 |
| 17 | —CN | 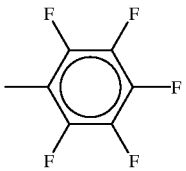 | —SPr(i) | 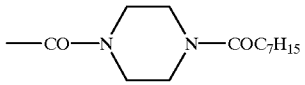 | 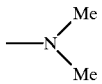 |

-continued
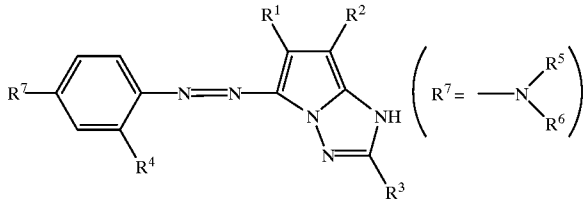
| M | $R^1$ | $R^2$ | $R^3$ | $R^4$ | $R^7$ |
|---|---|---|---|---|---|
| 18 | —CN | 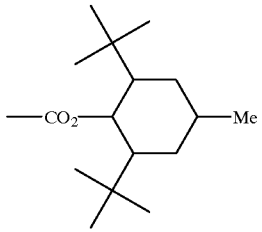 | 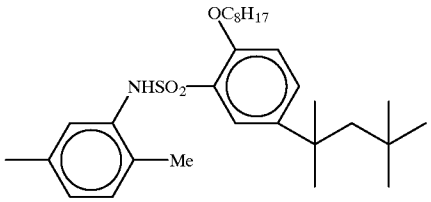 | $—SO_2C_{12}H_{25}$ | 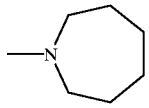 |
| 19 | —SOPh | 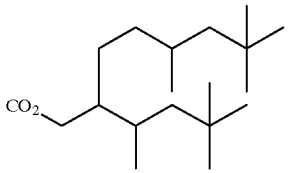 | —Bu(t) | —CN | 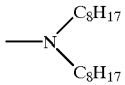 |
| 20 | —Ph | —Me | $—CO_2Bu$ | $—SO_2CH_2Ph$ | 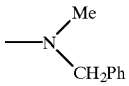 |
| 21 | —CN | 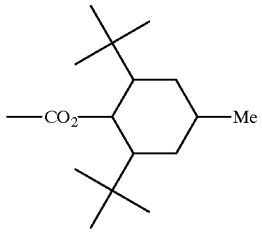 | 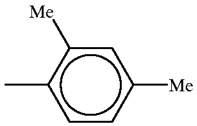 | $—SO_2C_{12}H_{25}$ | 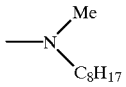 |

-continued
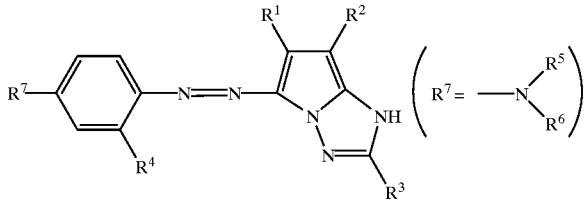
| M | $R^1$ | $R^2$ | $R^3$ | $R^4$ | $R^7$ |
|---|---|---|---|---|---|
| 22 | CN | $—CO_2Et$ | 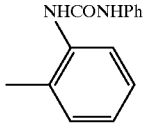 | $SO_2C_{12}H_{25}$ | 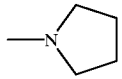 |
| 23 | CN | 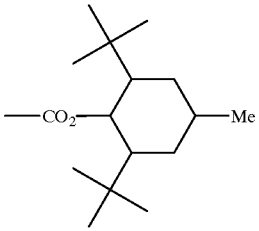 | 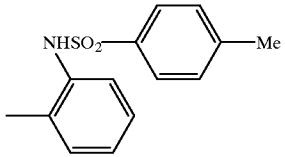 | $SO_2C_{12}H_{25}$ | 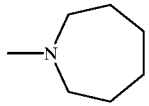 |
| 24 | CN | $—CO_2C_{14}H_{29}$ | 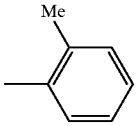 | $SO_2C_{12}H_{25}$ | 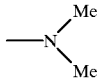 |
| 25 | CN | 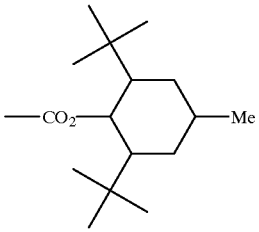 | 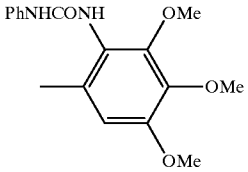 | $SO_2C_{12}H_{25}$ | 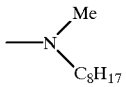 |

An example of the synthesis of a colorant of the present invention is described below. Other colorants can be synthesized by a similar method.

Synthesis of a Colorant (M-4)

0.55 g of a coupler (K-16) was dissolved in a solvent mixture comprising 5.0 ml of MeOH and 5.0 ml of THF. Then, 0.80 g of a diazo compound (A-6) was added to the solution, and further 0.2 ml of $Et_3N$ was added to the solution. The solution was stirred at room temperature for 1.5 hours. Upon completion of the reaction, a dilute aqueous solution of hydrochloric acid was added to the reaction solution to make it acidic. The mixture was then extracted with ethyl acetate. The extract was washed with water, and thereafter dried by using $MgSO_4$. After removal of the solvent from the solution at a reduced pressure, the residue as a crude product was subjected to crystallization by using isopropanol. In this way, 0.76 g of the target product (M-4) was obtained.

By the way, it should be noted that compounds represented by general formulas include tautomers thereof.

In the photo- and heat-sensitive recording material of the present invention, in order to improve the storability of the recording material before use, it is desirable to enclose the diazo compound in microcapsules. The microcapsules can be formed by a known method. The polymeric substance forming the capsule wall needs to be a compound through which materials cannot pass at room temperature but through which materials can pass when the microcapsule is heated. The glass transition temperature of the polymeric substance is preferably 60 to 200° C. Examples of the polymeric substance include polyurethane, polyurea, polyamide, polyester, a urea/formaldehyde resin, a melamine resin, polystyrene, a styrene/methacrylate copolymer, a styrene/acrylate copolymer, and a mixture thereof.

An appropriate method for forming microcapsules is an interface polymerization method and an inner polymerization method. The details of the method for forming microcapsules and specific examples of the reactants are described in U.S. Pat. Nos. 3,726,804 and 3,796,669. For example, in a case in which polyurea or polyurethane is to be used as a capsule wall, the capsule wall preparing process comprises the steps of mixing polyisocyanate and a second substance (e.g., polyol or polyamine) which reacts therewith to form the capsule wall in an aqueous medium or in an oily medium to be encapsulated, emulsifying the mixture of the mediums in water, and heating the resulting emulsion so that a polymerization reaction takes place in the oil droplets interface. In this process, even if the addition of the second substance is omitted, polyurea is formed.

In the present invention, the polymeric substance which forms the capsule wall is preferably at least one substance selected from polyurethane and polyurea.

A method for preparing microcapsules (having a polyurea or polyurethane wall) enclosing a diazo compound in the present invention is described below.

First, a diazo compound is dissolved or dispersed in a hydrophobic organic solvent which will become the capsule core. The boiling point of the organic solvent is preferably 100 to 300° C. Further, a polyvalent isocyanate as a wall material is added to the core forming organic solvent (oil phase).

On the other hand, an aqueous solution as aqueous phase containing a water-soluble polymer, such as polyvinyl alcohol or gelatin, is prepared. The oil phase is then placed in the aqueous solution, and the emulsification is carried out by means of, for example, a homogenizer. In the emulsification, the water-soluble polymer acts as a stabilizer. In order to further stabilize the emulsification process, a surfactant may be added to at least one of the oil phase and the aqueous phase.

The amount of the polyvalent isocyanate to be used is selected such that the average particle diameter of the microcapsules is 0.3 to 12 $\mu$m, and the wall thickness is 0.01 to 0.3 $\mu$m. Usually, the diameters of the dispersed particles are about 0.2 to 10 $\mu$m. In the emulsion, a polyurea wall is formed in this case because a polymerization reaction of the polyvalent isocyanate takes place in the interface between the oil phase and the aqueous phase.

If a polyol is added to the aqueous phase, a polyurethane wall can be formed by the reaction between the polyvalent isocyanate and the polyol (described in details later). In order to increase the reaction rate, it is preferable to keep the reaction temperature at an elevated temperature or to add a suitable polymelization catalyst. Details of the polyvalent isocyanate, polyol, reaction catalyst, and polyamine for forming part of the wall are described in, for example, "Polyurethane Handbook" edited by K. Iwata and published by Nikkan Kogyo Shinbun Co., Ltd., 1987.

The polyvalent isocyanate for use as a material for the wall of the microcapsules is preferably a compound having an isocyanate group which is trifunctional or more. However, a compound having an isocyanate group which is difunctional or more can be used together. Specific examples of the polyvalent isocyanate include a dimer or trimer (burette or isocyanurate) which is produced mainly from a diisocyanate such as xylenediisocyanate and a hydrogenated product thereof, hexamethylenediisocyanate, tolylenediisocyanate and a hydrogenated product thereof, and isophoronediisocyanate; a polyfunctional adduct made from a polyol such as trimethylol propane and a difunctional isocyanate such as xylenediisocyanate; a compound produced by introducing a polymeric compound such as a polyether having active hydrogen, e.g., polyethylene oxide, into an adduct made from a polyol such as trimethylol propane and a difunctional isocyanate such as xylenediisocyanate; and a condensation product from benzeneisocyanate and formalin.

These compounds preferable for use in the present invention are described in, for example, JP-A Nos. 62-212,190, 4-26,189, 5-317,694, and Japanese Patent Application No. 8-268,721.

Further, a polyol or a polyamine, which is added in advance to a hydrophobic solvent forming a core or to an aqueous solution of a water-soluble polymer serving as a dispersing medium, can be used as one of the materials which form the wall of microcapsules. Examples of the polyol or the polyamine include propylene glycol, glycerin, trimethylol propane, triethanolamine, sorbitol, and hexamethylenediamine. If a polyol is added, a polyurethane wall is formed.

The hydrophobic organic solvent in which the diazo compound is dissolved to form a core of the microcapsule is preferably an organic solvent having a boiling point of 100 to 300° C. Specific examples of the organic solvent include alkylnaphthalene, alkyldiphenylethane, alkyldiphenylmethane, alkylbiphenyl, alkylterphenyl, chlorinated paraffin, phosphoric esters, maleic esters, adipic esters, phthalic esters, benzoic esters, carboxylic esters, ethers, sulfuric esters, and sulfonic esters. These maybe used in a combination of two or more.

If a diazo compound to be encapsulated has a poor solubility in the organic solvent, a solvent in which the diazo compound to be encapsulated has a higher solubility and which has a lower boiling point may be used as an auxiliary solvent. Specific examples of the auxiliary solvent include ethyl acetate, propyl acetate, isopropyl acetate, butyl acetate, methylene chloride, tetrahydrofuran, acetonitrile, and acetone. In short, it is preferable that the diazo compound have an appropriate solubility in the high-boiling hydrophobic solvent and the low-boiling auxiliary solvent. More specifically, the solubility of the diazo compound in the hydrophobic organic solvent is preferably 5% or more, and the solubility of the compound in water is preferably 1% or less.

The water-soluble polymer for use in an aqueous solution of the water-soluble polymer, into which aqueous solution the oil phase of capsules thus prepared is dispersed, is a water-soluble polymer whose solubility in water is 5% or more at the temperature at which the emulsification is carried out. Specific examples of the water-soluble polymer include polyvinyl alcohol or modified product thereof, polyacrylamide or a modified product thereof, an ethylene/vinyl acetate copolymer, a styrene/maleic anhydride copolymer, an ethylene/maleic anhydride copolymer, an isobutylene/maleic anhydride copolymer, polyvinylpyrrolidone, an ethylene/acrylic acid copolymer, a vinyl acetate/acrylic acid copolymer, carboxymethyl cellulose, methyl cellulose, casein, gelatin, a derivative of starch, gum arabic, and sodium alginate.

Preferably, the water-soluble polymer has little or no reactivity to an isocyanate compound. A compound such as gelatin, whose molecular chain has a reactive amino group, is preferably modified in advance so that the reactivity is lost.

If a surfactant is added, the amount of the surfactant to be added is preferably 0.1 to 5%, more preferably 0.5 to 2%, based on the weight of the oil phase.

The emulsification can be carried out by a known apparatus, such as homogenizer, menton gorille, ultrasonic disperser, dissolver, or Keddy mill. After the emulsification, the emulsion is heated to 30 to 70° C. so as to accelerate the reaction for the formation of the capsule wall. Meanwhile, during the reaction, in order to prevent the coagulation of the capsules, it is necessary to add water to the emulsion so that the collision between the capsules can be prevented, and/or to stir the emulsion sufficiently.

It is also possible to add a dispersing agent for the prevention of the coagulation during the reaction. As the polymerization reaction proceeds, the generation of carbon dioxide gas is observed, and the point at which the generation of the gas ceases can be generally regarded as the end point of the capsule wall forming reaction. Usually, after a reaction of several hours, the desired microcapsules enclosing the diazo compound can be obtained.

The coupler for use in the present invention may be dispersed in a solid state together with a basic substance and other color forming auxiliary in anaqueous solution containing a water-soluble polymer, by means of a sand mill or the like. Also possible is a process comprising the steps of dissolving the coupler in a solvent which is either slightly soluble in water or insoluble in water, and blending the solution with an aqueous phase comprising as protective colloid a surfactant and/or a water-soluble polymer to thereby produce an emulsion. In order to facilitate the emulsification, it is preferable to use a surfactant.

The organic solvent which is used in the above-mentioned case can be appropriately selected from oils having a high boiling point described in, for example, JP-A No. 2-141,279.

Among them, an ester is preferred from the standpoint of the stability of the emulsion, and tricresyl phosphate is most preferred.

A mixture of the above-described oils as well as a mixture of the above-described oil with other type of oil can be used.

A solvent, which has a higher solvency and has a lower boiling point, may be added as an auxiliary solvent to the above-described organic solvent. Specific examples of the auxiliary solvent include ethyl acetate, isopropyl acetate, butyl acetate, and methylene chloride. Depending on the cases, the low-boiling auxiliary solvent alone can be used without using the high-boiling oil.

The water-soluble polymer incorporated as a protective colloid into the aqueous phase, which phase is to be mixed with the oil phase containing the above-described components, can be appropriately selected from anionic polymers, nonionic polymers, and amphoteric polymers. Preferred examples of the water-soluble polymer include polyvinyl alcohol, gelatin, and cellulosic derivatives.

The surfactants in the aqueous phase can be appropriately selected from anionic surfactants and nonionic surfactants which do not cause precipitation or coagulation by reacting with the protective colloid. Preferred examples of the surfactant include sodium alkylbenzenesulfonate, sodium alkylsulfate, sodium dioctylsulphosuccinate, and polyalkylene glycol (e.g., polyoxyethylenenonylphenyl ether).

In the present invention, an organic base can also be used in order to accelerate the coupling reaction between the diazo compound and the coupler. The organic bases may be used singly or in a combination of two or more. Examples of the basic substance include nitrogen-containing compounds such as tertiary amines, piperidines, piperazines, amidines, formamidines, pyridines, guanidines, and morpholines. These compounds are described in, for example, JP-B No. 52-46,806, JP-A Nos. 62-70,082, 57-169,745, 60-94,381, 57-123,086, and 60-49,991, JP-B Nos. 2-24,916 and 2-28,479, and JP-A Nos. 60-165,288 and 57-185,430.

Among these substances, particularly preferred are piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, and 1,4-bis{[3-(N-methylpiperazino)-2-hydroxy]propypoxy}benzene; morpholines such as N-[3-(β-naphthoxy)-2-hydroxy]propylmorpholine, 1,4-bis(3-morpholino-2-hydroxy-propyloxy)benzene, and 1,3-bis(3-morpholino-2-hydroxy-propyloxy)benzene; piperidines such as N-(3-phenoxy-2-hydroxypropyl)piperidine and N-dodecylpiperidine; and guanidines such as tirphenylguanidine, tricyclohexylguanidine, and dicyclohexylguanidine.

In the present invention, the amount of the coupler and the amount of the basic substance, respectively, to be used are preferably 0.1 to 30 parts by weight, per part of weight of the diazo compound.

In the present invention, besides the organic bases, a color forming aid agent(auxiliary) can be added in order to accelerate the color forming reaction. The color forming aid agent is a substance which either increases the density of the color formed or lowers the temperature at which the color formation begins at the time of the thermal recording. The color forming aid agent produces an environment which facilitates the reaction of the diazo compound, the basic substance, the coupler, and others by, for example, lowering the melting points of the diazo compound, the basic substance, the coupler, and others, and/or lowering the softening point of the capsule wall.

For example, in order to carry out the thermal printing quickly and perfectly by a smaller amount of energy, color forming aid agents, such as phenol derivatives, naphthol derivatives, alkoxy-substituted benzenes, alkoxy-substituted naphthalenes, aromatic ethers, thioethers, esters, amides, ureidos, urethanes, sulfonamides, and hydroxyl compounds, can be used according to the present invention.

It is desirable to use a known antioxidant as described below in the photo- and heat-sensitive recording material of the present invention in order to improve the durability of the thermally formed color image against light and heat, or in order to reduce the yellowing by light of the unprinted area after fixing process.

The antioxidants are described in, for example, European Patent Application Laid-Open Nos. 223,739, 309,401, 309,402, 310,551, 310,552, 459,416; German Patent Application Laid-Open No. 3,435,443; JP-A Nos. 54-48,535, 62-262,047, 63-113,536, 63-163,351, 2-262,654, 2-71,262, 3-121,449, 5-61,166, 5-119,449; and U.S. Pat. Nos. 4,814,262 and 4,980,275.

Further, in the present invention, it is effective to use an additive which is known effective for use in heat sensitive recording materials and pressure sensitive recording materials. Examples of the additive include the compounds described in, for example, JP-A Nos. 60-107,384, 60-107,383, 60-125,470, 60-125,471, 60-125,472, 60-287,485, 60-287,486, 60-287,487, 60-287,488, 61-160,287, 61-185,483, 61-211,079, 62-146,678, 62-146,680, 62-146,679, 62-282,885, 63-051,174, 63-89,877, 63-88,380, 63-088,381, 63-203,372, 63-224,989, 63-251,282, 63-267,594, 63-182,484, 1-239,282, 4-291,685, 4-291,684, 5-188,687, 5-188,686, 5-110,490, 5-170,361, JP-B Nos. 48-043,294 and 48-033,212.

Specific examples of the additive include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanecarboxylate, 2,2-bis(4-hydroxyphenyl)propane, 1,1-bis(4-hydroxyphenyl)-2-ethylhexane, 2-methyl-4-methoxy-diphenylamiline, and 1-methyl-2-phenylindole.

The respective amounts of the antioxidant and the additive to be used are preferably 0.05 to 100 parts by weight, more preferably 0.2 to 30 parts by weight, per part of weight of the diazo compound.

When using the antioxidant and the additive, they may be contained together with a diazo compound in the microcapsules, they may be dispersed together with a coupler, a basic substance, and other color forming aid agent in a solid dispersion, or they may be emulsified together with an emulsifying aid, or alternatively they may be included in both of the states (solid dispersion state and the emulsion state) The antioxidants or the additives may be used singly or in a combination of two or more, respectively. The antioxidant and the additive may be added to or contained in a protective layer.

The antioxidant and the additive do not need to be added to the same layer. Further, when a plurality of the antioxidants and the additives are used in combination, they may be at first classified into groups according to their chemical structure, such as into anilines, alkoxybenzenes, hindered phenols, hindered amines, hydroquinone derivatives, phosphorus-containing compounds, and sulfur-containing compounds. Then, a combination of different groups of the antioxidants and the additives, or a combination of the antioxidants or the additives of the same group may be employed.

In order to reduce the yellowing of the ground after recording process, the photo- and heat-sensitive recording material of the present invention may contain a free radical generating agent (a compound which generates a free radical when irradiated with light) which is used in a photopolymerizable composition or the like. Examples of the free radical generating agent include aromatic ketones, quinones, benzoins, benzoin ethers, azo compounds, organodisulfides, and acyloxime esters. The amount of the free radical generating agent to be added is preferably 0.01 to 5 parts by weight, per part of weight of the diazo compound.

In order to reduce the yellowing of the ground after recording process, the photo- and heat-sensitive recording material of the present invention may also contain a polymerizable compound having an ethylenic unsaturated bond (hereinafter referred to as a vinyl monomer). The vinyl monomer means a compound which has at least one ethylenic unsaturated bond (e.g., a vinyl group, a vinylidene group, or the like) in the molecular structure thereof and which is in a chemical form of a monomer or a prepolymer. Examples of the compound include an unsaturated carboxylic acid and a salt thereof, an ester made up of an unsaturated carboxylic acid and an aliphatic polyhydric alcohol, and an amide made up of an unsaturated carboxylic acid and an aliphatic polyvalent amine. The amount of the vinyl monomer to be added is 0.2 to 20 parts by weight, per part of weight of the diazo compound.

The free radical generating agent and the vinyl monomer may be contained together with the diazo compound in the microcapsules.

Besides the above-described substances, the photo- and heat-sensitive recording material of the present invention may contain citric acid, tartaric acid, oxalic acid, boric acid, phosphoric acid, and pyrophosphoric acid as a stabilizer.

When preparing the photo- and heat-sensitive recording material of the present invention, a coating liquid, which comprises microcapsules enclosing a diazo compound, a coupler, an organic base, and other additive, is first prepared. The coating liquid is then applied onto a substrate, such as a paper, a synthetic film, or the like, by such method as bar coating, blade coating, air knife coating, gravure coating, roll coating, spraying, dipping, or curtain coating, and thereafter the coating layer is dried to thereby form a heat sensitive layer having a solid content in the range of 2.5 to 30 $g/m^2$.

In the photo- and heat-sensitive recording material of the present invention, microcapsules, a coupling component, a base, and others may be contained in the same layer, or they may be contained in different layers so that a multilayered recording material is prepared. Further, an intermediate layer may be formed on the substrate, and thereafter a heat sensitive layer may be formed on the intermediate layer, as described in, for example, Japanese Patent Application No. 59-177,669.

A known water-soluble polymeric compound and a latex can be used as the binder for use in the photo- and heat-sensitive recording material of the present invention. Specific examples of the water-soluble polymeric material include methyl cellulose, carboxymethyl cellulose, hydroxyethyl cellulose, hydroxypropyl cellulose, a derivative of starch, casein, gum arabic, gelatin, an ethylene/maleic anhydride copolymer, a styrene/maleic anhydride copolymer, polyvinyl alcohol, silanol-modifiedpolyvinyl alcohol, carboxy-modified polyvinyl alcohol, an epichlorohydrin-modified polyamide, an isobutylene/maleic anhydride salicylic acid copolymer, polyacrylic acid, polyacrylic amide, and modified products thereof. Examples of the latex include a styrene/butadiene rubber latex, a methyl acrylate/butadiene rubber latex, and a vinyl acetate emulsion. Preferred examples are hydroxyethyl cellulose, a derivative of starch, a gelatin, a derivative of polyvinyl alcohol, and a derivative of polyacrylic amide.

A known pigment, irrespective of organic or inorganic pigment, can be used as the pigment for use in the photo- and heat-sensitive recording material of the present invention. Specific examples of the pigment include kaolin, calcined kaolin, talc, pyrophyllite, diatomaceous earth, calcium carbonate, aluminum hydroxide, magnesium hydroxide, zincoxide, lithopone, amorphous silica, colloidal silica, calcined gypsum, silica, magnesium carbonate, titanium oxides, alumina, barium carbonate, barium sulfate, mica, micro-balloon, a urea/formalin filler, polyester particles, and a cellulosic filler.

If necessary, a known additive, such as a wax, an antistatic agent, a defoaming agent, an electroconducting agent, a fluorescent dye, a surfactant, an ultraviolet light absorber, and a precursor thereof, can be used in the photo- and heat-sensitive recording material of the present invention.

If necessary, a protective layer may be disposed on the surface of the recording layer of the photo- and heat-sensitive recording material of the present invention. If necessary, the protective layer may be composed of two or more layers. Examples of the material for the protective layer include water-soluble polymeric material, such as polyvinyl alcohol, carboxy-modified polyvinyl alcohol, a vinyl acetate/acrylamide copolymer, silicon-modified polyvinyl alcohol, starch, modified starch, methyl cellulose, carboxymethyl cellulose, hydroxymethyl cellulose, gelatin, gum arabic, casein, a hydrolysate of a styrene/maleic anhydride copolymer, a hydrolysate of a half ester of a styrene/maleic anhydride copolymer, a hydrolysate of an isobutylene/maleic anhydride copolymer, a derivative of polyacrylamide, polyvinyl pyrrolidone, sodium polystyrenesulfonate, and sodium alginate; and latices such as a styrene/butadiene rubber latex, an acrylonitrile/butadiene rubber latex, a methyl acrylate/butadiene rubber latex, and a vinyl acetate emulsion. The storability can be further improved by cross-linking the water-soluble polymeric compound of the protective layer. The cross-linking agent for that purpose can be a known cross-linking agent. Examples of the cross-linking agent include a water-soluble initial-stage condensate suchas N-methylol urea, N-methylol melamine, or urea/formalin; a dialdehyde compound such as glyoxal or glutaraldehyde; an inorganic cross-linking agent such as boric acid or borax; and polyamide/epichlorohydrin. In addition, the protective layer may contain a known pigment, metal soap, wax, surfactant, or the like. The coating amount of the protective layer is preferably 0.2 to 5 g/m$^2$, and more preferably 0.5 to 2 g/m$^2$. The thickness of the coating is preferably 0.2 to 5 $\mu$m, and more preferably 0.5 to 2 $\mu$m.

If a protective layer is used in the photo- and heat-sensitive recording material of the present invention, the protective layer may contain a known ultraviolet light absorber or a precursor thereof.

A paper substrate for use in an ordinary pressure-sensitive paper or heat-sensitive paper as well as for use in a dry-system or wet-system diazo copying paper can be used as a substrate according to the present invention. In addition, usable are a acidic paper, a neutral paper, a coated paper, a plastic film-laminated paper, a synthetic paper, a plastic film, and the like.

Further, in order to correct the curl balance of the substrate, or in order to improve the chemical resistance on the backside of the substrate, a back coat layer may be disposed, or a release paper may be affixed to the backside of the substrate, interposing an adhesive layer therebetween, to thus provide a label form. The back coat may be formed in the same way as the protective layer.

When the recording surface of the photo- and heat-sensitive recording material of the present invention is heated by, for example, a thermal head, the capsule wall of the polyurea and/or the polyurethane is softened to an extent that allows the coupler and the basic compound present outside the capsule to penetrate the inside of the capsule so as to develop a color. After the color is developed, the recording surface is irradiated with light having wavelength corresponding to the absorption wavelength of the diazo compound. Since the irradiation decomposes the diazo compound to lose the reactivity to the coupler, the fixing of the image is effected.

Examples of the light source include a fluorescent lamp, a xenon lamp, and a mercury lamp. From the standpoint of efficient fixing, the spectrum of the light is preferably nearly the same as that of the absorption spectrum of the diazo compound in the photo- and heat-sensitive recording material of the present invention.

In the present invention, the central wavelength of the light for fixing is most preferably in the range of 360 to 440 nm.

In the present invention, a multi-color recording material can be prepared if photo-decomposable diazo compounds having different photo-decomposition wavelengths are used in different layers. Multi-color recording materials are described in, for example, JP-A Nos. 3-288,688, 4-135,787, 5-194,842, and 5-34,860.

If the photo- and heat-sensitive recording material of the present invention is used as a multilayered, multi-color recording material, an intermediate layer may be disposed in order to prevent the mixing of colors of the layers of photo- and heat-sensitive recording material. The intermediate layer may comprise a water-soluble polymeric compound, such as gelatin, phthalated gelatin, polyvinyl alcohol, or polyvinylpyrrolidone, and an appropriate additive.

EXAMPLES

The following examples further illustrate the present invention. They are not to be construed to limit the scope of the present invention. In the examples, "part" indicates "part by weight" unless otherwise indicated.

Example 1

(Preparation of a liquid A containing microcapsules in which a diazonium salt is encapsulated)

2.8 parts of a diazo compound (A-6) and 10 parts of tricresyl phosphate were added to and uniformly mixed with 19 parts of ethyl acetate. This liquid was mixed with 7.6 parts of "Takenate D110N" (manufactured by Takeda Chemical Industries, Ltd.) which serves as a capsule wall forming material. In this way, liquid I was obtained. The liquid I was added to a liquid comprising 46 parts of a 8% aqueous solution of phthalated gelatin, 17.5 parts of water, and 2 parts of a 10% aqueous solution of sodium dodecylbenzenesulfonate. The resulting mixture was emulsified in a condition of 40° C. and 10,000 rpm for 10 minutes by using a homogenizer. 20 parts of water was added to the emulsion thus obtained, and the emulsion was homogenized. Then, the emulsion was kept at 40° C. for 3 hours with stirring, so that an encapsulating reaction proceeded. In this way a capsule liquid A was obtained. The diameters of the capsules were in the range of 0.7 to 0.8 $\mu$m.

(Preparation of a liquid B (a coupler emulsion))

3 parts of a coupler (K-16), 3 parts of triphenylguanidine, 0.5 parts of tricresyl phosphate, and 0.24 parts of diethyl maleate were dissolved in 10.5 parts of ethyl acetate. In this way, liquid II was obtained.

The liquid II was added to a liquid prepared by uniformly blending 49 parts of a 15% aqueous solution of lime-treated gelatin, 9.5 parts of a 10% aqueous solution of sodium dodecylbenzenesulfonate, and 35 parts of water at 40° C. The resulting mixture was emulsified in a condition of 40° C. and 10,000 rpm for 10 minutes by using a homogenizer. The emulsion thus obtained was stirred at 40° C. for 2 hours to remove the ethyl acetate by evaporation. Then, water in an amount equivalent to the total of the evaporated ethyl acetate and the evaporated water was added to the emulsion. In this way a liquid B (a coupler emulsion) was obtained.

(Preparation of a coating liquid C for forming a photo- and heat-sensitive recording layer)

A coating liquid C for forming a photo- and heat-sensitive recording layer was obtained by blending 3.6 parts of the capsule liquid A, 3.3 parts of water, and 9.5 parts of the liquid B of a coupler emulsion.

(Preparation of a coating liquid D for forming a protective layer)

A coating liquid D for forming a protective layer was obtained by a process comprising blending 100 parts of a 6% aqueous solution of itaconic acid-modified polyvinyl alcohol ("KL-318" manufactured by Kuraray Co., Ltd.) and 10 parts of a 30% dispersion liquid of an epoxy-modified polyamide ("FL-71" manufactured by Toho Chemical Co., Ltd.), and then admixing the resulting liquiduniformlywith 15 parts of a 40% dispersion liquid of zinc stearate ("Hydrine Z" manufactured by Chukyo Oil and Fats Co., Ltd.).

(Coating)

The coating liquid C for forming a photo- and heat-sensitive recording layer was applied by means of a wired bar to the surface of a substrate, which was made by laminating polyethylene to a fine paper and which was to be used for a photographic paper, and dried at 50° C. The coating liquid D for forming a protective layer was then applied to the surface of the recording layer in the same way and dried in the same way to obtain a desired photo- and heat-sensitive recording material. The coating amount, based on solids, of the recording layer and the protective layer were 8.0 g/m$^2$ and 1.2 g/m$^2$, respectively.

(Color formation test)

For the color formation, a thermal head "KST" manufactured by Kyocera Corp. was used. The image forming electric power and the pulse width for the thermal head were selected so that the recording energy per unit area was 50 mj/mm$^2$. Under this condition, a thermal printing operation was performed and an image was obtained in the photo- and heat-sensitive recording material. The recording material carrying the image thus obtained was exposed to the light emitted from an ultraviolet lamp having a central wavelength of 420 nm and an output power of 40 W for 10 seconds. By using the colored image obtained in this way, the wavelength at peak absorption and a half band width (i.e., the range of wavelength for an absorbance of 0.5 if the absorbance at the peak absorption is taken as 1.0) in the visible region were measured.

Example 2

In order to prepare a photo- and heat-sensitive recording material and evaluate it, the procedure of Example 1 was repeated, except that K-21 was used as the coupler.

Example 3

In order to prepare a photo- and heat-sensitive recording material and evaluate it, the procedure of Example 1 was repeated, except that A-14 was used as the diazo compound.

Example 4

In order to prepare a photo- and heat-sensitive recording material and evaluate it, the procedure of Example 3 was repeated, except that K-25 was used as the coupler.

Example 5

In order to prepare a photo- and heat-sensitive recording material and evaluate it, the procedure of Example 3 was repeated, except that K-20 was used as the coupler.

Example 6

In order to prepare a photo- and heat-sensitive recording material and evaluate it, the procedure of Example 5 was repeated, except that A-29 was used as the diazo compound.

Comparative Example 1

In order to prepare a photo- and heat-sensitive recording material and evaluate it, the procedure of Example 1 was repeated, except that H-1 was used as the coupler.

H-1

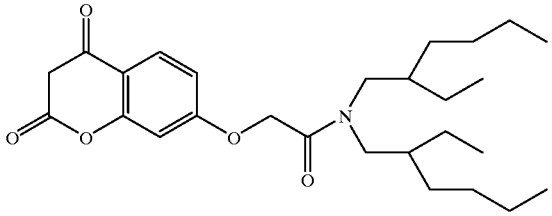

(Compound B-13 as described in Japanese Patent Application No. 9-152,414)

The results of Examples 1~6 and Comparative Example 1 are shown in Table 1.

TABLE 1

| | Coupler | Diazo Compound | Absorption Peak (nm) | Half Band Width (nm) |
|---|---|---|---|---|
| Example 1 | K-16 | A-6 | 560.2 | 120.4 |
| Example 2 | K-21 | A-6 | 561.1 | 118.3 |
| Example 3 | K-16 | A-14 | 557.4 | 119.9 |
| Example 4 | K-25 | A-14 | 557.2 | 119.3 |
| Example 5 | K-20 | A-14 | 554.9 | 125.6 |
| Example 6 | K-20 | A-29 | 540.4 | 124.1 |
| Example 7 | H-1 | A-6 | 531.2 | 155.9 |

From the results, it can be seen that the photo- and heat-sensitive recording material of the present invention provides a colored image having very sharp absorption characteristics.

Example 7

An ethyl acetate solution ($2\times10^{-5}$ mol/liter) of the colorant (M-1) of the present invention was prepared. By using the absorption spectrum of this solution, the wavelength at peak absorption and a half band width (explained previously) were measured.

Example 8

The procedure for the measurement of Example 7 was repeated, except that M-4 was used as the colorant.

Example 9

The procedure for the measurement of Example 7 was repeated, except that M-5 was used as the colorant.

Example 10

The procedure for the measurement of Example 7 was repeated, except that M-8 was used as the colorant.

Example 11

The procedure for the measurement of Example 7 was repeated, except that M-11 was used as the colorant.

Example 12

The procedure for the measurement of Example 7 was repeated, except that M-12 was used as the colorant.

Example 13

The procedure for the measurement of Example 7 was repeated, except that M-16 was used as the colorant.

Example 14

The procedure for the measurement of Example 7 was repeated, except that M-18 was used as the colorant.

Example 15

The procedure for the measurement of Example 7 was repeated, except that M-21 was used as the colorant.

Example 16

The procedure for the measurement of Example 7 was repeated, except that M-22 was used as the colorant.

Comparative Example 2

The procedure for the measurement of Example 7 was repeated, except that H-2 was used as the colorant.

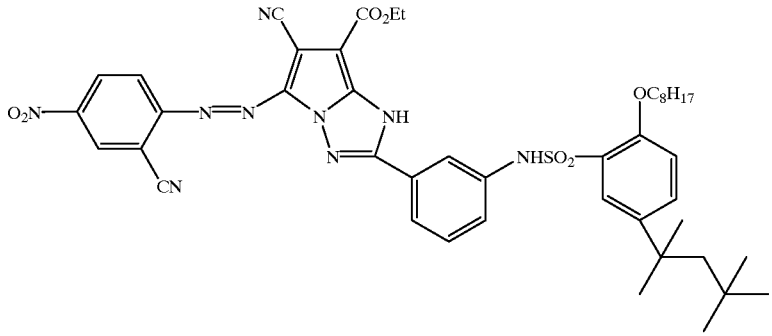

The results of Examples 7~16 and Comparative Example 2 are shown in Table 2.

TABLE 2

| | Colorant | Absorption Peak (nm) | Half Band Width (nm) |
|---|---|---|---|
| Example 7 | M-1 | 525.1 | 83.5 |
| Example 8 | M-4 | 531.2 | 78.0 |
| Example 9 | M-5 | 524.3 | 84.4 |
| Example 10 | M-8 | 529.4 | 80.0 |
| Example 11 | M-11 | 528.9 | 80.7 |
| Example 12 | M-12 | 533.4 | 83.3 |
| Example 13 | M-16 | 528.7 | 79.3 |
| Example 14 | M-18 | 530.5 | 77.4 |
| Example 15 | M-21 | 529.6 | 83.4 |
| Example 16 | M-22 | 546.4 | 83.5 |
| Comparative Example 2 | H-2 | 555.0 | 115.7 |

From the results, it can be seen that the colorant of the present invention is a magenta colorant having very sharp absorption characteristics.

As a conclusion, the present invention provides a photo- and heat-sensitive recording material which carries a colored image having very sharp absorption characteristics and which exhibits excellent color reproduction. The recording material also provides a magenta colorant having very sharp absorption characteristics.

What is claimed is:

1. A photo- and heat-sensitive recording material comprising:

a substrate; and a photo- and heat-sensitive recording layer formed on the substrate, the layer containing a photo-decomposable diazo compound and a coupler, wherein the coupler is a compound represented by the general formula (1) or the general formula (2):

General Formula (1)

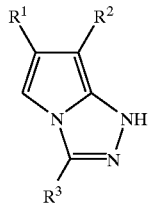

-continued

General Formula (2)

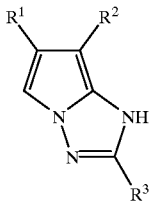

where $R^1$, $R^2$ and $R^3$ are each independently a hydrogen atom or a substituent group; and $R^1$ and $R^2$ may join with each other to form a ring.

2. A photo- and heat-sensitive recording material according to claim 1, wherein the substituent groups include halogen atoms, alkyl, aryl, heterocyclic, cyano, hydroxyl, nitro, carboxyl, sulfo, amino, alkoxy, aryloxy, acylamino, alkylamino, anilino, ureido, sulfamoylamino, alkylthio, arylthio, alkoxycarbonylamino, sulfonamide, carbamoyl, sulfamoyl, sulfonyl, alkoxycarbonyl, heterocycloxy, azo, acyloxy, carbamoyloxy, silyloxy, aryloxycarbonylamino, imido, heterocyclothio, sulfinyl, phosphonyl, aryloxycarbonyl, acyl, and azolyl groups.

3. A photo- and heat-sensitive recording material according to claim 1, wherein $R^1$ and $R^2$ are each an electron withdrawing group having a Hammett's substitution constant $\sigma_p$ of 0.20 or more, and preferably 0.30 or more.

4. A photo- and heat-sensitive recording material according to claim 1, wherein the diazo compound is a compound having an absorption peak in the range of 380 to 450 nm.

5. A photo- and heat-sensitive recording material according to claim 1, wherein the diazo compound is a compound represented by the general formula (3):

General formula (3)

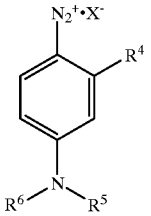

where $R^4$ isselected from the group consisting of alkylsulfinyl, arylsulfinyl, alkylsulfonyl, arylsulfonyl, sulfamoyl, alkoxycarbonyl, carbamoyl, acyl, and cyano groups; $R^5$ and $R^6$ are each a hydrogen atom, an alkyl group, or an aryl group; $X^-$ is an negative ion; and $R^5$ and $R^6$ may join with each other to form a ring.

6. A photo- and heat-sensitive recording material according to claim 1, wherein the diazo compound is enclosed in microcapsules.

7. A photo- and heat-sensitive recording material according to claim 1, wherein the coupler undergoes a coupling reaction with a diazo compound to form a colorant in an basic environment and/or a neutral environment.

8. A photo- and heat-sensitive recording material according to claim 1, wherein a substance, which includes an active methylene compound, a phenol derivative, and a naphthol derivative, is used as an additional coupler with the coupler.

9. A photo- and heat-sensitive recording material according to claim 1, wherein at least one type of diazo compound represented by the general formula (3) is used.

10. A photo- and heat-sensitive recording material according to claim 1, wherein the coupler represented by the general formula (2) reacts with a specific diazo compound to produce a colorant represented by the following general formula (4):

General formula (4)

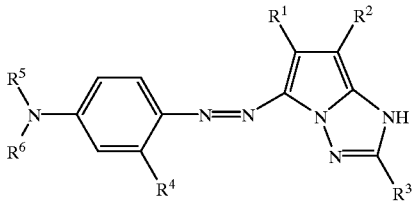

where $R^1$, $R^2$ and $R^3$ are each independently a hydrogen atom or a substituent group; $R^1$ and $R^2$ may join with each other to form a ring; $R^4$ is selected from the group consisting of alkylsulfinyl, arylsulfinyl, alkylsulfonyl, arylsulfonyl, sulfamoyl, alkoxycarbonyl, carbamoyl, acyl, and cyano groups; $R^5$ and $R^6$ are each a hydrogen atom, an alkyl group, or an aryl group; $X^-$ is an negative ion; and $R^5$ and $R^6$ may join with each other to form a ring.

11. A photo- and heat-sensitive recording material according to claim 1, wherein the components are contained in the one and the same layer to form a single-layered structure, or the components are contained in different layers to form a multilayered structure.

12. A photo- and heat-sensitive recording material according to claim 1, wherein at least one protective layer is disposed on the surface of the photo- and heat-sensitive recording layer.

13. A photo- and heat-sensitive recording material according to claim 1, wherein the photo- and heat-sensitive recording material is a multi-color recording material having a multilayered structure in which each layer contains a photo-decomposable diazo compound, and the photo-decomposition wavelength of a photo-decomposable compound in any given layer is different from the photo-decomposition wavelengths of the photo-decomposable diazo compounds in the other layers.

14. A photo- and heat-sensitive recording material comprising:

a substrate; and a photo- and heat-sensitive recording layer formed on the substrate, the layer containing a diazo compound and a coupler, wherein the coupler is a compound represented by the general formula (2):

General formula (2)

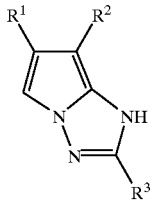

and wherein the coupler represented by the general formula (2) reacts with a specific diazo compound to produce a colorant represented by the following general formula (4):

General formula (4)

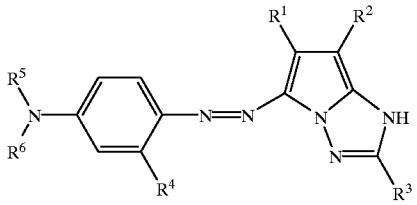

where $R^1$, $R^2$ and $R^3$ are each independently a hydrogen atom or a substituent group; $R^1$ and $R^2$ may join with each other to form a ring; $R^4$ is selected from the group consisting of alkylsulfinyl, arylsulfinyl, alkylsulfonyl, arylsulfonyl, sulfamoyl, alkoxycarbonyl, carbamoyl, acyl, and cyano groups; $R^5$ and $R^6$ are each a hydrogen atom, an alkyl group, or an aryl group; $X^-$ is an negative ion; and $R^5$ and $R^6$ may join with each other to form a ring.

15. A photo- and heat-sensitive recording material according to claim 14, wherein the substituent groups include halogen atoms, alkyl, aryl, heterocyclic, cyano, hydroxyl, nitro, carboxyl, sulfo, amino, alkoxy, aryloxy, acylamino, alkylamino, anilino, ureido, sulfamoylamino, alkylthio, arylthio, alkoxycarbonylamino, sulfonamide, carbamoyl, sulfamoyl, sulfonyl, alkoxycarbonyl, heterocycloxy, azo, acyloxy, carbamoyloxy, silyloxy, aryloxycarbonylamino, imido, heterocyclothio, sulfinyl, phosphonyl, aryloxycarbonyl, acyl, and azolyl groups.

16. A photo- and heat-sensitive recording material according to claim 14, wherein $R^1$ and $R^2$ are each an electron withdrawing group having a Hammett's substitution constant $\sigma_p$ of 0.20 or more, and preferably 0.30 or more.

17. A photo- and heat-sensitive recording material according to claim 14, wherein the diazo compound is a compound having an absorption peak in the range of 380 to 450 nm.

18. A photo- and heat-sensitive recording material according to claim 14, wherein the diazo compound is a compound represented by the general formula (3):

General formula (3)

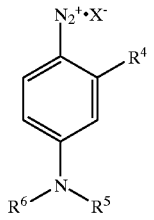

where $R^4$ is selected from the group consisting of alkylsulfinyl, arylsulfinyl, alkylsulfonyl, arylsulfonyl, sulfamoyl, alkoxycarbonyl, carbamoyl, acyl, and cyano groups; $R^5$ and $R^6$ are each a hydrogen atom, an alkyl group, or an aryl group; $X^-$ is an negative ion; and $R^5$ and $R^6$ may join with each other to form a ring.

19. A photo- and heat-sensitive recording material according to claim 14, wherein the diazo compound is enclosed in microcapsules.

* * * * *